US007325610B2

(12) United States Patent
Giroux et al.

(10) Patent No.: US 7,325,610 B2
(45) Date of Patent: Feb. 5, 2008

(54) METHODS AND APPARATUS FOR HANDLING AND DRILLING WITH TUBULARS OR CASING

(75) Inventors: Richard L. Giroux, Cypress, TX (US); David Shahin, Houston, TX (US); Adrian Vuyk, Jr., Houston, TX (US); Gary Thompson, Katy, TX (US); Kevin Leon Gray, Friendswood, TX (US); John Timothy Allen, Katy, TX (US); Randy Gene Snider, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 320 days.

(21) Appl. No.: 10/795,129

(22) Filed: Mar. 5, 2004

(65) Prior Publication Data

US 2005/0000691 A1 Jan. 6, 2005

Related U.S. Application Data

(63) Continuation-in-part of application No. 10/389,483, filed on Mar. 14, 2003, which is a continuation of application No. 09/550,721, filed on Apr. 17, 2000, now Pat. No. 6,536,520.

(60) Provisional application No. 60/452,192, filed on Mar. 5, 2003, provisional application No. 60/452,156, filed on Mar. 5, 2003.

(51) Int. Cl.
*E21B 33/14* (2006.01)

(52) U.S. Cl. ..... 166/291; 166/70; 166/78.1; 166/177.4

(58) Field of Classification Search ..... 166/291, 166/177.4, 70, 78.1
See application file for complete search history.

(56) References Cited

U.S. PATENT DOCUMENTS 122,514 A 1/1872 Bullock (Continued)

FOREIGN PATENT DOCUMENTS

CA 2 307 386 11/2000

(Continued)

OTHER PUBLICATIONS

Invitation to Pay Additional Fees, International Application No. PCT/US2004/006750, dated Aug. 16, 2004.

(Continued)

*Primary Examiner*—Hoang Dang
(74) *Attorney, Agent, or Firm*—Patterson & Sheridan, LLP

(57) ABSTRACT

The present invention provides a method and apparatus for handling tubulars and drilling with tubulars such as casing into a formation. In one aspect of the invention, the apparatus comprises a circulating head and a cementing head operatively connectible to a gripping member. The circulating head is used to circulate drilling fluid while drilling with casing, and the cementing head is used to cement the casing string within the formation at a desired depth. The present invention also relates to methods and apparatus for isolating a tensile load from a drilling apparatus rotated by a top drive. In one aspect, the present invention provides a load isolator apparatus having an isolator body operatively connected to the top drive and a torque body at least partially disposed in the isolator body. In operation, the bearing assembly transfers the tensile load from the torque body to the isolator body.

53 Claims, 17 Drawing Sheets

U.S. PATENT DOCUMENTS

| | | | |
|---|---|---|---|
| 179,973 | A | 7/1876 | Thornton |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,138 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |
| 2,414,719 | A | 7/1947 | Cloud |
| 2,499,630 | A | 3/1950 | Clark |
| 2,522,444 | A | 9/1950 | Grable |
| 2,536,458 | A | 1/1951 | Munsinger |
| 2,570,080 | A | 10/1951 | Stone |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bleber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,965,177 | A | 12/1960 | Bus, Sr. et al. |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillbum |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,266,582 | A | 8/1966 | Hornanick |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,638,989 | A | 2/1972 | Sandquist |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,706,347 | A | 12/1972 | Brown |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,776,320 | A | 12/1973 | Brown |
| 3,776,991 | A | 12/1973 | Marcus |
| 3,780,883 | A | 12/1973 | Brown |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swobada, Jr. et al. |
| 3,848,684 | A | 11/1974 | West |
| 3,857,450 | A | 12/1974 | Guier |
| 3,870,114 | A | 3/1975 | Pulk et al. |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongysi et al. |
| 3,915,244 | A | 10/1975 | Brown |
| 3,934,660 | A | 1/1976 | Nelson |
| 3,945,444 | A | 3/1976 | Knudson |
| 3,947,009 | A | 3/1976 | Nelmark |
| 3,964,552 | A | 6/1976 | Slator |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |
| 4,077,525 | A | 3/1978 | Callegari et al. |
| 4,082,144 | A | 4/1978 | Marquis |

4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,927 A 12/1978 Hauk et al.
4,133,396 A 1/1979 Tschirky
4,142,739 A 3/1979 Billingsley
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,202,225 A 5/1980 Sheldon et al.
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A 11/1990 Terrell
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk 5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.

5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 * 8/2001 Mosing et al. ..... 166/285
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,334,376 B1 1/2002 Torres
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 * 8/2002 Bouligny ..... 294/86.25
6,433,241 B2 9/2002 Juhasz et al.
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes

| | | | |
|---|---|---|---|
| 6,725,924 | B2 | 4/2004 | Davidson et al. |
| 6,725,938 | B1 | 4/2004 | Pietras |
| 6,732,822 | B2 | 5/2004 | Slack et al. |
| 6,742,584 | B1 | 6/2004 | Appleton |
| 6,742,596 | B2 | 6/2004 | Haugen |
| 6,742,606 | B2 | 6/2004 | Metcalfe et al. |
| 6,745,834 | B2 | 6/2004 | Davis et al. |
| 6,752,211 | B2 | 6/2004 | Dewey et al. |
| 6,832,658 | B2 | 12/2004 | Keast |
| 6,837,313 | B2 | 1/2005 | Hosie et al. |
| 6,840,322 | B2 | 1/2005 | Haynes |
| 6,848,517 | B2 | 2/2005 | Wardley |
| 6,854,533 | B2 | 2/2005 | Galloway |
| 6,857,486 | B2 | 2/2005 | Chitwood et al. |
| 6,857,487 | B2 | 2/2005 | Galloway |
| 6,907,934 | B2 | 6/2005 | Kauffman et al. |
| 7,096,977 | B2 | 8/2006 | Juhasz et al. |
| 7,100,698 | B2 | 9/2006 | Kracik et al. |
| 2001/0000101 | A1 | 4/2001 | Lovato et al. |
| 2001/0002626 | A1 | 6/2001 | Frank et al. |
| 2001/0013412 | A1 | 8/2001 | Tubel |
| 2001/0040054 | A1 | 11/2001 | Haugen et al. |
| 2001/0042625 | A1 | 11/2001 | Appleton |
| 2001/0047883 | A1 | 12/2001 | Hanton et al. |
| 2002/0029878 | A1 | 3/2002 | Victor |
| 2002/0040787 | A1 | 4/2002 | Cook et al. |
| 2002/0066556 | A1 | 6/2002 | Goode et al. |
| 2002/0074127 | A1 | 6/2002 | Birckhead et al. |
| 2002/0074132 | A1 | 6/2002 | Juhasz et al. |
| 2002/0079102 | A1 | 6/2002 | Dewey et al. |
| 2002/0108748 | A1 | 8/2002 | Keyes |
| 2002/0134555 | A1 | 9/2002 | Allen et al. |
| 2002/0157829 | A1 | 10/2002 | Davis et al. |
| 2002/0162690 | A1 | 11/2002 | Hanton et al. |
| 2002/0170720 | A1 | 11/2002 | Haugen |
| 2002/0189806 | A1 | 12/2002 | Davidson et al. |
| 2002/0189863 | A1 | 12/2002 | Wardley |
| 2003/0029641 | A1 | 2/2003 | Meehan |
| 2003/0034177 | A1 | 2/2003 | Chitwood et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0070842 | A1 | 4/2003 | Bailey et al. |
| 2003/0111267 | A1 | 6/2003 | Pia |
| 2003/0141111 | A1 | 7/2003 | Pia |
| 2003/0146023 | A1 | 8/2003 | Pia |
| 2003/0155159 | A1 | 8/2003 | Slack et al. |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0016575 | A1 | 1/2004 | Shahin et al. |
| 2004/0060697 | A1 | 4/2004 | Tilton et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0112648 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalf et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |

| | | |
|---|---|---|
| GB | 2 240 799 | 8/1991 |
| GB | 2 275 488 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 349 401 | 11/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| JP | 2001/173349 | 6/2001 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/52297 | 9/2000 |
| WO | WO 00/66879 | 11/2000 |
| WO | WO 01/12946 | 2/2001 |
| WO | WO 01/33033 | 5/2001 |
| WO | WO 01/46550 | 6/2001 |
| WO | WO 01/59253 | 8/2001 |
| WO | WO 01/79650 | 10/2001 |
| WO | WO 01/79652 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |
| WO | WO 2004/079155 | 9/2004 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Driling are Options" Drilling Contractor, Jan./Feb. 2002, pp. 52.

M. Gelfgat, "Retractable Bits Development and Application" Transactions of the ASME, vol. 120, Jun. 1998, pp. 124-130.

"First Success with Casing-Drilling" Word Oil, Feb. 1999, pp. 25.

Dean E. Gaddy, Editor, "Russia Shares Technical Know-How with U.S." Oil & Gas Journal, Mar. 1999, pp. 51-52 and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/795,129, filed Mar. 5, 2004.

U.S. Appl. No. 10/788,976, filed Feb. 27, 2004.

U.S. Appl. No. 10/794,797, filed Mar. 5, 2004.

U.S. Appl. No. 10/767,322, filed Jan. 29, 2004.

U.S. Appl. No. 10/794,790, filed Mar. 5, 2004.

U.S. Appl. No. 10/162,305, filed Jun. 4, 2004.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

U.S. Appl. No. 10/618,093, filed Jul. 2003, Boyle.

U.S. Appl. No. 10/189,570, filed Jul. 2002, Vail.

Tarr, et al., "Casing-while-Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing-Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Colied Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001, Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-27.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
PCT Search Report, International Application No. PCT/US2004/006750, dated Nov. 4, 2004.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 pages.
Valves Wellhead Equipment Safety Systems, W-K-M Division, ACF Industries, Catalog 80, 1980, 5 pages.
Canrig Top Drive Drilling Systems, Harts Petroleum Engineer International, Feb. 1997, 2 pages.

The Original Portable Top Drive Drilling System, TESCO Drilling Technology, 1997.
Mike Killalea, Portable Top Drives: What's Driving The Marked?, IADC, Drilling Contractor, Sep. 1994, 4 pages.
500 or 650 ECIS Top Drive, Advanced Permanent Magnet Motor Technology, TESCO Drilling Technology, Apr. 1998, 2 pages.
500 or 650 HCIS Top Drive, Powerful Hydraulic Compact Top Drive Drilling System, TESCO Drilling Technology, Apr. 1998, 2 pages.
Product Information (Sections 1-10) CANRIG Drilling Technology, Ltd., Sep. 18, 1996.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properties, IBP 27500, Brazilian Petroleum Institute—IBP, 2000.
Coiled Tubing Handbook, World Oil, Gulf Publishing Company, 1993.
Bickford L. Dennis and Mark J. Mabile, Casing Drilling Rig Selection For Stratton Field, Texas, World Oil, vol. 226, No. 3, Mar. 2005.
G. H. Kamphorst, G. L. Van Wechem, W. Boom, D. Bottger, and K. Koch, Casing Running Tool, SPE/IADC 52770.

* cited by examiner

METHODS AND APPARATUS FOR HANDLING AND DRILLING WITH TUBULARS OR CASING

CROSS-REFERENCE TO RELATED APPLICATIONS

This application is a continuation-in-part of co-pending U.S. patent application Ser. No. 10/389,483 filed Mar. 14, 2003, which is herein incorporated by reference in its entirety. U.S. patent application Ser. No. 10/389,483 is a continuation of U.S. patent application Ser. No. 09/550,721 filed on Apr. 17, 2000, now U.S. Pat. No. 6,536,520, which is also herein incorporated by reference in its entirety.

This application claims benefit of U.S. Provisional Patent Application Ser. No. 60/452,192 fled on Mar. 5, 2003, which is herein incorporated by reference in its entirety. This application further claims benefit of U.S. Provisional Patent Application Ser. No. 60/452,156 filed on Mar. 5, 2003, which is herein incorporated by reference in its entirety.

BACKGROUND OF THE INVENTION

1. Field of the Invention

Embodiments of the present invention generally relate to handling tubulars and drilling into a formation to form a wellbore. More particularly, embodiments of the present invention relate to drilling with casing. Even more particularly, embodiments of the present invention relate to drilling with casing and cementing the casing into the formation.

2. Description of the Related Art

In conventional well completion operations, a wellbore is formed to access hydrocarbon-bearing formations by the use of drilling. In drilling operations, a drilling rig is supported by the subterranean formation and used to urge a drill string toward the formation. A rig floor of the drilling rig is the surface from which drilling strings with cutting structures, casing strings, and other supplies are lowered to form a subterranean wellbore lined with casing. A hole is formed in a portion of the rig floor above the desired location of the wellbore. The axis that runs through the center of the hole formed in the rig floor is the well center.

Drilling is accomplished by utilizing a drill bit that is mounted on the end of a drill support member, commonly known as a drill string. To drill within the wellbore to a predetermined depth, the drill string is often rotated by a top drive or rotary table on the drilling rig. After drilling to a predetermined depth, the drill string and drill bit are removed and a section of casing is lowered into the wellbore.

Often, it is necessary to conduct a pipe handling operation to connect sections of casing to form a casing string which extends to the drilled depth. Pipe handling operations require the connection of casing sections to one another to line the wellbore with casing. To threadedly connect the casing strings, each casing section must be retrieved from its original location, typically on a rack beside the drilling platform, and suspended above well center so that each casing section is in line with the casing section previously disposed within the wellbore. The threaded connection is made up by a device that imparts torque to one casing section relative to the other, such as a power tong or a top drive. The casing string formed of the two or more casing sections is then lowered into the previously drilled wellbore.

It is common to employ more than one string of casing or section of casing in a wellbore. In this respect, the well is drilled to a first designated depth with a drill bit on a drill string. The drill string is removed. Sections of casing are connected to one another and lowered into the wellbore using the pipe handling operation described above to form a first string of casing longitudinally fixed in the drilled out portion of the wellbore. The first string of casing may then be cemented into place within the wellbore by a cementing operation. Next, the well is drilled to a second designated depth through the first casing string, and a second, smaller diameter casing string or string of casing comprising casing sections is hung off of the first string of casing or section of casing. A second cementing operation may be performed to set the second string of casing within the wellbore. This process is typically repeated with additional casing sections or casing strings until the well has been drilled to total depth. In this manner, wellbores are typically formed with two or more strings of casing.

It is known in the industry to use top drive systems to rotate the drill string to form the wellbore. The quill of the top drive is typically threadedly connected to an upper end of the drill pipe in order to transmit torque to the drill pipe.

As an alternative to the conventional method, drilling with casing is a method often used to place casing strings within the wellbore. This method involves attaching a cutting structure typically in the form of a drill bit to the lower end of the same string of casing which will line the wellbore. Drilling with casing is often the preferred method of well completion because only one run-in of the working string into the wellbore is necessary to form and line the wellbore for each casing string.

Drilling with casing is typically accomplished using a top drive powered by a motor because the top drive is capable of performing both functions of imparting torque to the casing string to make up the connection between casing strings during pipe handling operations and of drilling the casing string into the formation. A problem encountered with top drive systems is the potential for damage to the threads of the drill pipe or casing. Damage to the casing threads is problematic because the casing connections must remain fluid and pressure tight once the drilling operation has been completed.

Gripping heads have been developed for gripping casing to prevent damage to the threads. The top drive is connected to a gripping head, which may be an external gripping device such as a torque head or an internal gripping device such as a spear. A torque head is a type of gripping head which grips the casing by expanding a plurality of jaws or slips against an exterior surface of the casing. A spear is a gripping head which includes slips for gripping an interior surface of the casing.

Gripping heads generally have a top drive adapter for connection to a top drive quill. In this respect, torque may be transmitted to the casing with minimal damage to the threads of the quill.

The gripping head has a bore therethrough through which fluid may flow. The gripping head grippingly engages the casing string to serve as a load path to transmit the full torque applied from the top drive to the casing string.

The top drive and the gripping head, when the gripping head grippingly engages the casing, function as the means for rotating the casing string, means for providing a sealed fluid path through the casing string, and means for lowering the casing string into the wellbore. To function as the means for lowering the casing string into the wellbore, the top drive is disposed on rails so that it is moveable axially in the plane substantially in line with well center. The rails also help the top drive impart torque to the casing string by keeping the top drive rotationally fixed.

Because the casing string is rotated by the top drive, the top drive also carries the tensile load of the casing string. Therefore, the top drive connection may be a limiting factor in the load that is actually applied. For example, the connection between the top drive and the torque head may limit the tensile load supportable by the top drive. The problem is exacerbated when drilling with casing because a casing typically weighs more than a drill pipe. As a well is drilled deeper, the tensile load of a drilling string of casing will increase faster than a drill string of drill pipe. Therefore, the drilling with casing operation may be prematurely stopped because the weight and drag of the casing drill string exceeded the tensile load rating of the top drive connection.

One proposed method of overcoming this problem is to increase the size of the threaded connection. While many drilling apparatus may be redesigned with a larger size threaded connection to increase its tensile load capacity, it is very costly and inefficient to redesign or replace a top drive already existing on a rig.

There is a need, therefore, for an apparatus for increasing the drilling capacity of a top drive. There is a further need for an apparatus that isolates the tensile load from the top drive connection. There is also a need for an apparatus for isolating tensile load that can be retrofitted with existing top drives.

During a typical drill pipe drilling operation, it is usually necessary to circulate drilling fluid while drilling the drill string into the formation to form a path within the formation through which the drill string may travel. Failure to circulate drilling fluid while drilling into the formation may cause the drill string to stick within the wellbore; therefore, it is necessary for a fluid circulation path to exist through the drill string being drilled into the formation.

When running a typical casing string into a drilled wellbore, fluid is often circulated to prevent the casing string from sticking. Thus, a circulating tool is used within the casing string to circulate fluid through the casing string while running the casing string into the drilled wellbore.

When it is desired to run the casing into the drilled out wellbore, the circulating tool is hooked up to the top drive and disposed within the casing string to allow circulation of the fluid. A check valve disposed in the bore of the circulating tool allows fluid flow from the surface of the well, through the casing string, and through the annular space between the outer diameter of the casing string and the formation, while preventing fluid from flowing back up through the check valve to the surface. The circulating tool further includes a packer or cup(s), usually an inflatable packer, disposed on its outer diameter. The packer is deployed to expand radially outward from the circulating tool to sealingly engage the inner diameter of the casing string. The packer and cup(s) seal the annular space between the outer diameter of the circulating tool and the inner diameter of the casing string; consequently, the packer isolates the inner diameter of the casing string below the packer to permit fluid under pressure to flow through the casing string and up through the annular space between the outer diameter of the casing string and the formation.

After the circulating tool is used to run the casing string to the desired depth within the formation, the casing string is often cemented into the wellbore at a certain depth before an additional casing string is hung off of the casing string so that the formation does not collapse onto the casing string due to lack of support. Furthermore, the casing string is often cemented into the formation once it reaches a certain depth to restrict fluid movement between formations. To cement the casing string within the wellbore, a cementing tool including a cementing head is inserted into the casing string to inject cement and other fluids downhole and to release cement plugs. The cementing head typically includes a plug releasing apparatus, which is incorporated into the cementing head above the wellbore. Plugs used during a cementing operation are held at the surface by the plug releasing apparatus. The typical cementing head also includes some mechanism which allows cement or other fluid to be diverted around the plugs until plug release is desired. Fluid is directed to bypass the plugs in some manner within the container until it is ready for release, at which time the fluid is directed to flow behind the plug and force it downhole.

The cementing head including an upper cement plug and a lower cement plug is used to cement the wellbore. The cement plugs typically define an elongated elastomeric body used to separate cement pumped into the wellbore from fluid ahead of and behind the cement. The lower cement plug has radial wipers to contact and wipe the inside of the casing string as the plug travels down the casing string. The lower cement plug has a cylindrical bore therethrough to allow passage of cement. The cylindrical bore is typically closed to flow with a rupture or breakable disc or diaphragm. The disc or diaphragm breaks or ruptures when the lower plug lands on a barrier to allow the passage of cement through the plug.

The lower cement plug is typically pumped ahead of the cement. After a sufficient volume of cement has been placed into the wellbore, an upper cement plug is deployed. Using drilling mud, cement, or other displacement fluid, the upper cement plug is launched or pumped into the bore of the casing string. The upper cement plug is then pumped down the casing with displacement fluid, typically mud or water. As the upper cement plug travels downhole, it displaces the cement already in the bore of the casing to the annular area defined as the external casing diameter and the borehole. When the upper plug arrives at the barrier, it seats against the lower cement plug already landed on the barrier, closing off the internal bore through the lower cement plug, thus stopping flow into the annular area.

To perform a cementing operation, the circulating tool must be retrieved from the casing string and set aside before the cementing tool can be installed on the casing string. The casing string is typically supported by a spider which grippingly engages the outer diameter of the casing string on the rig floor at well center. Then, an entirely separate cementing tool is installed on the casing string by being threadedly connected or clamped onto an upper portion of the casing string to perform a cementing operation.

When using a separate cementing tool, extra time is necessary to rig down the gripping head and circulation tool and then rig up the cementing tool when it is desired to cement the casing string into the formation. Extra time results in extra labor and money spent on the operation. Using a separate cementing tool to conduct a cementing operation also requires the hardware for the circulating tool as well as the additional hardware for an entirely separate cementing tool.

There is a need for an integrated apparatus which adapts the top drive for gripping casing and includes circulating and cementing functions. There is a need for a means for gripping and rotating casing as the casing string is constructed (e.g., making up or breaking out the threaded connection between casings), as well as a means for rotating the casing during the drilling operation. There is also a need to decrease the amount of time between the drilling into the formation and the cementing of the casing into the formation. There is a further need to decrease the amount of hardware necessary at the drilling rig to drill into the formation and cement the casing into the formation.

SUMMARY OF THE INVENTION

Embodiments of the present invention include a method of forming a wellbore comprising operatively connecting a circulating head to a gripping mechanism; grippingly and sealingly engaging a first tubular with the gripping mechanism; lowering the first tubular into a formation; operatively connecting a cementing plug to the gripping mechanism; grippingly and sealingly engaging a second tubular with the gripping mechanism; and lowering the second tubular into the formation. In another aspect, embodiments of the present invention include an apparatus for use in drilling with casing comprising a tubular body having a fluid flow path therethrough; a circulating seal member and a cementing plug operatively connectible to the tubular body; and a gripping member for gripping the casing.

Other embodiments of the present invention provide an apparatus for compensating a gripping head comprising a mandrel operatively engaged to a gripping head housing to form a torque-bearing connection; and at least one biasing member connected between the mandrel and the gripping head. In other embodiments, the present invention includes a method of cementing a casing within a formation, comprising providing a gripping mechanism connected to a cementing assembly; grippingly and sealingly engaging the casing with the gripping mechanism; moving the casing to a depth within the formation; and cementing the casing within the formation using the cementing assembly without releasing the gripping and sealing engagement of the casing.

Embodiments of the present invention involve an apparatus which includes a tubular body with a bore therethrough. In one embodiment, a circulating head and a cementing head are interchangeably and operatively connectible to a lower end of the tubular body. The circulating head circulates fluid through a casing string or casing section. The cementing head circulates fluid to cement the casing string or casing section into the formation at a desired depth.

In one aspect, the cementing head comprises plugs which are releasable in response to longitudinal translation of a mandrel disposed within the bore of the tubular body. The plugs temporarily restrict fluid flow through the bore of the tubular body. In one embodiment, the slidable mandrel is moveable in response to fluid pressure (e.g., hydraulic or pneumatic).

In another aspect, embodiments of the present invention involve a method of cementing a wellbore using the apparatus comprising the tubular body having a circulating head interchangeable with a cementing head. In one embodiment, the method includes releasably and operatively attaching the circulating head to a lower end of the tubular body, grippingly and sealingly engaging a first casing with the apparatus, drilling the first casing to a first depth in a formation, removing the circulating head from the tubular body, releasably and operatively attaching a cementing head to the lower end of the tubular body, grippingly and sealingly engaging a second casing with the apparatus, drilling the second casing to a second depth in the formation, using the cementing head to plug fluid flow through the second casing, and introducing a physically alterable bonding material into the apparatus.

Embodiments of the present invention allow a drilling with casing operation, including the drilling operation and the cementing operation, to be conducted by merely changing a lower portion of the apparatus. Embodiments of the present invention eliminate the need to use a separate cementing tool for the cementing operation, thus reducing the time and labor required for the operation. Consequently, the cost of the drilling with casing operation is reduced.

Embodiments of the present invention also generally relate to methods and apparatus for isolating a tensile load from a drilling apparatus rotated by a top drive. In one aspect, the present invention provides a load isolator apparatus having an isolator body operatively connected to the top drive and a torque body at least partially disposed in the isolator body. The torque body is position such that the torque body is rotatable relative to the isolator body. The load isolator apparatus also includes a bearing assembly disposed between the isolator body and the torque body. The torque body is operatively coupled to a tensile load of the drilling apparatus. In operation, the bearing assembly transfers the tensile load from the torque body to the isolator body.

In another aspect, the present invention provides a method of rotating a drilling apparatus having a tensile load using a top drive. The method includes operatively connecting a load isolator apparatus to the top drive. Preferably, the load isolator apparatus includes a torque body disposed in an isolator body. Thereafter, the tensile load is transferred to the torque body, which, in turn, transfers the tensile load from the torque body to the isolator body. During rotation by the top drive, the torque body rotates relative to the isolator body.

In another aspect still, the present invention provides an elevator for use with a top drive. The elevator having an isolator body and a torque body at least partially disposed in the isolator body. The torque body defines a conical bore that houses one or more slip members. The elevator may further include one or more bearing members disposed between the torque body and the isolator body. Preferably, the torque body is rotatable relative to the isolator body, and a tensile load acting on the torque body is transferred to the isolator body.

In yet another aspect, the present invention provides a top drive adapter for use with a top drive to rotate a drilling apparatus. The top drive adapter includes an isolator body and a torque body at least partially disposed in the isolator body. The torque body includes a first coupling for connection with the top drive and a second coupling for connection with the drilling apparatus. The top drive adapter also includes one or more bearing members disposed between the torque body and the isolator body. Preferably, the torque body is rotatable relative to the isolator body, and a tensile load acting on the torque body is transferred to the isolator body.

In yet another aspect, the present invention provides an apparatus for controlling the fluid pressure supplied to the top drive. In one aspect, the apparatus includes a fluid supply line disposed between the pump and the top drive for supplying fluid to the top drive. A pressure relief valve is disposed on the fluid supply line and a fluid return line connects the pressure relief valve and the pump. When a fluid pressure reaches a predetermined level, the pressure relief valve redirects the fluid back to the pump via the fluid return line.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
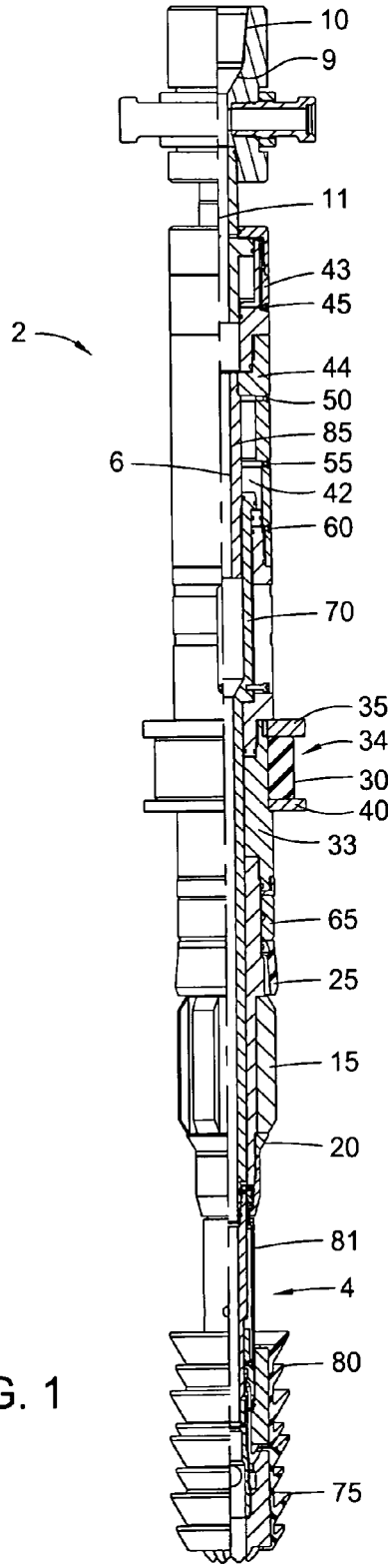
FIG. 1 is a sectional view of a combination circulating/cementing tool of the present invention. The right side of FIG. 1 is cut away to show the parts of the tool.

FIG. 1 is a combination circulation/cementing tool 2 according to the present invention. The tool 2 has a tubular-shaped plug release mandrel 85 with a longitudinal bore therethrough. A sub 9 located at an upper portion of the tool 2 connects a lower portion of a connector mandrel 11 to an upper portion of the tool 2. Threads 10 are located at an upper end of the sub 9 so that the tool 2 is capable of connection to other tools such as a top drive 200 (see FIG. 2). Any other connection means known to those skilled in the art may be utilized in lieu of threads.

Connected to a lower end of the connector mandrel 11 by at least one sealing member such as an O-ring is a tubular-shaped releasing body 43 with a longitudinal bore therethrough. The releasing body 43 has a plug release 45 located thereon. The releasing body 43 allows the shorting of the tool 2 to release the slips on either the torque head or spear (described below) in case of a hydraulic lock.

An upper end of a plug release body 44 is threadedly connected to a lower end of the releasing body 43. The plug release body 44 is tubular-shaped with a longitudinal bore therethrough. The plug release body 44 has three hydraulic ports 50, 55, 60 located thereon to which hydraulic lines (not shown) may be connected, including an upper port 50, a middle port 55 located below the upper port 50, and a lower port 60 located below the middle port 55. The ports 50, 55, 60 are utilized in various stages of the cementing operation, as described below.

A lower end of the plug release body 44 is threadedly connected to an upper end of a landing plate mandrel 33, which is a tubular-shaped body with a longitudinal bore therethrough. The landing plate mandrel 33 is essentially a coupling with female threads located on its upper end and lower end for threadedly connecting to male threads located on the ends of the portions of the tool 2 above and below the landing plate mandrel 33. Any other connection means known by those skilled in the art may be utilized other than threads. Disposed on the landing plate mandrel 33 is a landing plate 34, which includes an upper plate 35, a sealing member such as a cushion packer 30, and a lower plate 40. The upper plate 35 is located above the cushion packer 30, and the lower plate 40 is located below the cushion packer 30. The landing plate 34 rests on top of a casing coupling 305, 405 connected to a casing 300, 400 (see FIGS. 3 and 4). The casing 300, 400 may be a casing section or a casing string including two or more casing sections connected, preferably threadedly connected, to one another. Specifically, the lower plate 40 rests on the casing coupling 305, 405, while the cushion packer 30 is constructed of an elastomeric material to allow for slight (or larger) lateral movement of the tool 2 with respect to the casing when landing the landing plate 34 on the casing coupling 305, 405.

A tubular-shaped packer mandrel 20 with a longitudinal bore therethrough is connected, preferably threadedly connected, to the landing plate mandrel 33. An upper portion of the packer mandrel 20 has a sealing member, preferably a packer 65, disposed therearound. The packer 65 is preferably made of an elastomeric material so that it is selectively expandable to contact an inner diameter of the casing 300, 400. A cup packer 25 is disposed on the outer diameter of the packer mandrel 20 below the packer 65 to energize the packer 65. The packer 65 is activated to seal an annular area between the tool 2 and the casing 300, 400 when circulating fluid, thereby isolating the inner diameter of the casing 300, 400 so that fluid may be pumped under pressure through the casing 300, 400. In an alternate embodiment, an inflatable packer or a cup without a packing element may be used with the cementing tool 2. Below the cup packer 25, a centralizer 15 is disposed around the packer mandrel 20. The centralizer 15 is used to centralize the tool 2 within the casing 300, 400.

As shown in FIG. 1, a cementing head 4 having a plug set is releasably connected to a lower end of the packer mandrel 20. The cementing head 4 comprises an upper plug chamber 81, which is tubular-shaped with a longitudinal bore therethrough. The cementing head 4 includes a lower cement plug 75 located below an upper cement plug 80. The cement plugs 75, 80 are releasably connected to one another by a collet 72 (see FIG. 4) disposed on an upper portion of the lower cement plug 75. Each cement plug 75, 80 includes a flapper valve (not shown), which is initially biased in the open position so that fluid may flow through the cement plugs 75, 80. The lower cement plug 75 has a rupture disk (not shown) disposed thereon. The rupture disk initially blocks cement from traveling through the lower cement plug 75 as it travels downhole ahead of the cement. After the lower cement plug 75 lands on an internal diameter restriction such as a drill shoe, application of a predetermined pressure above the lower cement plug 75 by a cement volume causes the rupture disk to burst so that cement is allowed through the cement plugs 75, 80, out through the casing 400, and up through the annular space between the casing 400 and the formation (not shown).

An upper portion of a plug release mandrel 85 is connected to an upper portion of the plug release body 44. Disposed between a lower portion of the plug release mandrel 85 and a lower portion of the plug release body 44 is a slidable mandrel 70. The slidable mandrel 70 is a piston which is slidable within the cylinder formed by an annular space 42 between the plug release mandrel 85 and the plug release body 44. Shown in FIG. 1, the slidable mandrel 70 is in an unactuated position, so that the plugs 75, 80 are not launched. As fluid is introduced into the hydraulic ports 50, 55, 60, the slidable mandrel 70 slides upward relative to the plug release mandrel 85 and the plug release body 44. The upward movement of the slidable mandrel 70 launches the lower cement plug 75 and the upper cement plug 80, as described below.

Figure 2:
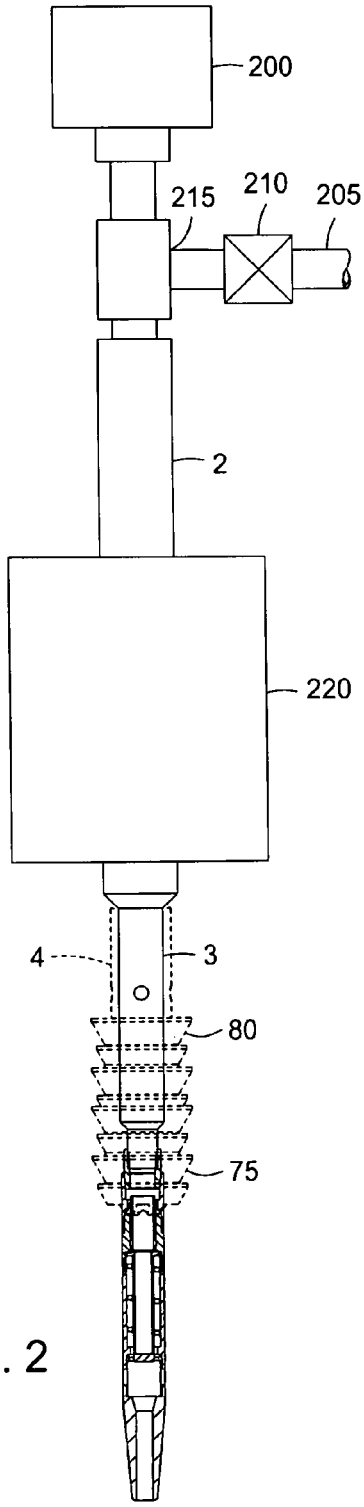
FIG. 2 is a schematic view of a system including the cementing/circulating tool of FIG. 1, the system also including a top drive, cement line, and torque head.

FIG. 2 is a schematic view of a system for using the circulation/cementing tool 2 according to the present invention. A top drive 200 is connected, preferably threadedly connected, to the tool 2. The top drive 200 is typically suspended from a draw works (not shown) with cable bails (not shown) and disposed on tracks (not shown) which allow longitudinal movement of the top drive 200, and thus, longitudinal movement of the connected tool 2. The top drive 200 performs the function of rotating the tool 2 during the drilling operation; therefore, the tool 2 is rotatable relative to the top drive 200. The tool 2, however, is preferably axially fixed relative to the top drive 200 so that the draw works (not shown) may be used to lift or lower the top drive 200 longitudinally, thus lifting or lowering the tool 2 therewith.

A cement line 205 extends through a port 215 running through the tool 2. A physically alterable bonding material, preferably a setting fluid such as cement, is selectively introduced through the cement line 205 and into the tool 2 through selective operation of a check valve 210. When it is desired to introduce cement into the tool 2, such as during the cementing operation, the check valve 210 is manipulated into an open position. When it is desired to prevent cement introduction into the tool 2, such as during the drilling operation when circulation fluid rather than cement is circulated through the tool 2, the check valve 210 is closed. Placing the cement line 205 below the top drive 200 allows the cement to bypass the top drive 200 during the cementing operation, thus preventing possible damage to the top drive 200.

Figure 6:
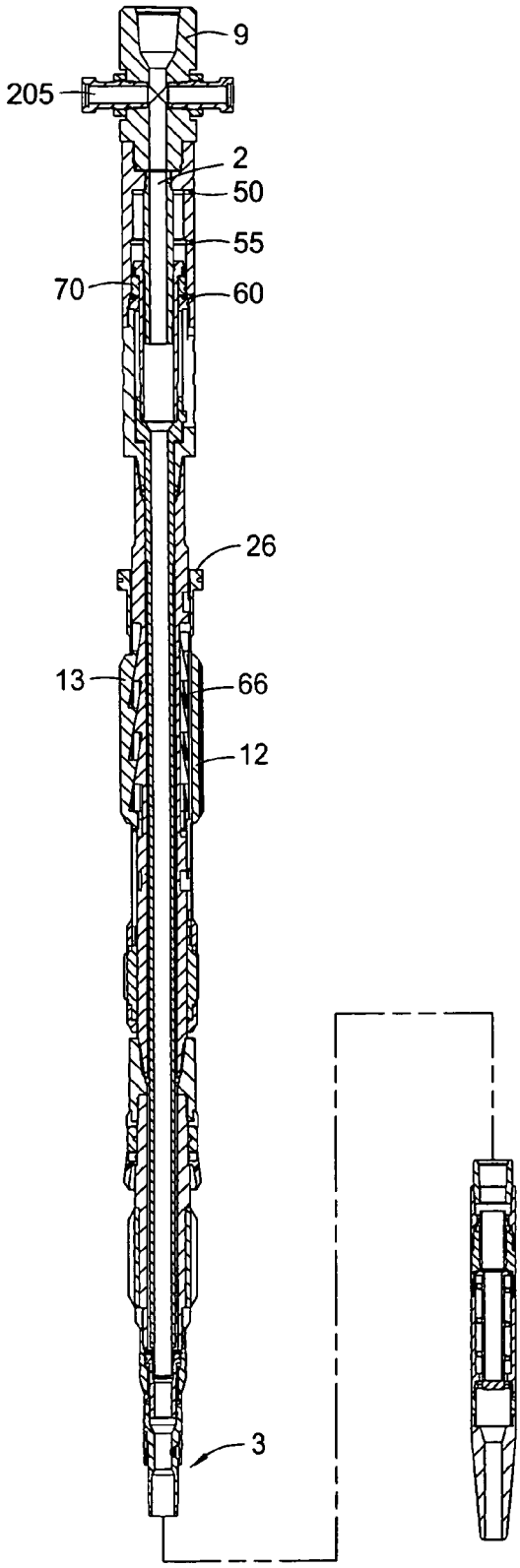
FIG. 6 is a sectional view of a circulating/cementing tool used with a spear as a circulating tool while drilling with casing. A spear is located within the casing to grippingly engage the casing.

A torque head 220 is rigidly connected to the tool 2. The torque head 220 is used to grippingly and sealingly engage the casing 300, 400 (see FIGS. 3 and 4). In the alternative, a spear 66 may be used to grippingly and sealing engage the casing 300, 400, as shown in FIG. 6 and described below. The torque head 220 imparts torque to the casing 300, 400 from the top drive 200 by grippingly engaging the casing 300, 400. The torque head 220 rotates with the tool 2 relative to the top drive 200.

The tool 2 runs through the torque head 220. A lower portion of the tool 2 is shown located below the torque head 220. The solid lines indicate the circulating/cementing tool 2 with a circulating head 3 placed thereon. The dotted lines indicate the tool 2 with the cementing head 4 placed thereon. When drilling with the casing 300, the circulating head 3 is placed at the lower portion of the tool 2 to circulate drilling fluid. When a cementing operation is to be conducted, the cementing head 4 is placed at the lower portion of the tool 2. The circulating head 3 may be connected, preferably threadedly connected, to a lower portion of the packer mandrel 20, so that to replace the circulating head 3 with the cementing head 4, the circulating head 3 must merely be unscrewed. The cementing head 4 may then be threadedly connected to the packer mandrel 20. In the same way, the cementing head 4 may be unscrewed, then the circulating head 3 threaded onto the packer mandrel 20, depending upon the function which the tool 2 is to perform.

Figure 3:
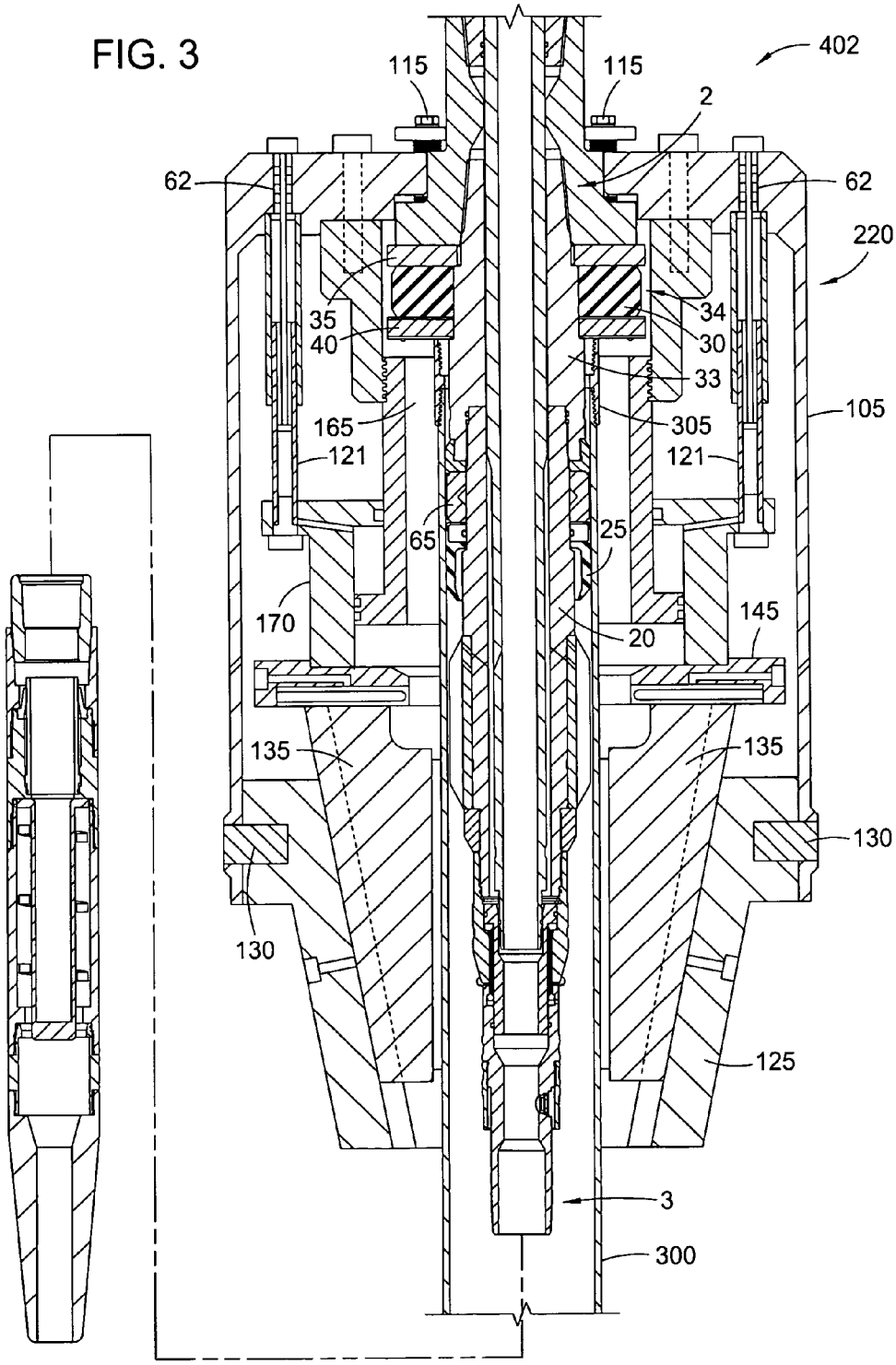
FIG. 3 is a sectional view of the circulating/cementing tool located within a torque head. The torque head is grippingly engaging casing disposed therein. The circulating/cementing tool is used as a circulating tool while drilling the casing into the formation.

FIG. 3 shows a lower portion of the tool 2 rigidly connected to the torque head 220, preferably by one or more bolts 115. As shown in FIG. 3, the circulating head 3 is connected to the lower portion of the tool 2 so that the casing 300 may be drilled into the formation while the tool 2 dispenses circulating fluid. The casing 300 is disposed between the torque head 220 and the tool 2. The casing 300, which typically has male threads disposed at its upper end, is connected, preferably threadedly connected, to the casing coupling 305 by female threads located at both ends of the casing coupling 305. The female threads of the casing coupling 305 are used to mate the casing 300 with another casing (not shown) to line the wellbore with casing. The lower plate 40 of the landing plate 34 is located directly above the upper female thread of the casing coupling 305 during the drilling operation, as shown in FIG. 3.

Any gripping mechanism capable of grippingly and sealingly engaging an outer or inner diameter of the casing 300 is suitable for use with the tool 2 of the present invention. The torque head 220 shown in FIG. 3 may be used as the gripping mechanism to grip the outer diameter of the casing 300, while the spear 66 shown in FIG. 6 may also be used instead of the torque head 220 to grip the inner diameter of the casing 300.

As shown in FIG. 3, the torque head 220 has a central bore 165 therethrough in which the casing 300 and the tool 2 are disposed. The torque head 220 includes a tubular-shaped housing 105 through which the bolts 115 connect the torque head 220 to the tool 2. One or more dowels 130 rigidly connect an inner diameter of a bowl 125 having an inclined inner wall to the housing 105. One or more gripping members 135, preferably slips, are disposed within the bowl 125 to grippingly engage an outer diameter of the casing 300. The inner sides of the slips 135 may carry teeth formed on hard metal dies for engaging the casing 300. The inclined surfaces of the slips 135 and the bowl 125 allow the slips 135 to move vertically and radially inward relative to the bowl 125 to grippingly engage the casing 300.

An annular ram drive 170 is connected to a plate 145 disposed above the slips 135 and serves as means for moving the slips 135 along the incline of the bowl 125 so that the slips 135 grippingly engage the outer diameter of the casing 300. One or more actuators 121, preferably hydraulic actuators, for the slips 135 are connected to an upper portion of the annular ram drive 170. One or more springs 62 are held initially in a biased position by the actuator 121 when the slips 135 are unactuated. When it is desired to grip the casing 300 within the torque head 220, a hydraulic line (not shown) may be hooked up to the actuator 121 to force the one or more springs 62 to compress, thus actuating the slips 135 of the torque head 220 so that the slips 135 move along the inclined surface of the bowl 125 and grippingly engage the outer diameter of the casing 300.

FIG. 6 shows the spear 66 instead of the torque head 220 used as the gripping mechanism with the tool 2. The spear 66 includes a tubular body 13 with a longitudinal bore therethrough. One or more slips 12 are disposed on an outer diameter of the tubular body 13 above the circulating head 3 or cementing head 4 (the circulating head 3 is shown with the spear 66 in FIG. 6). When actuated, the slips 12 are used to grippingly and sealingly engage the inner diameter of a casing (not shown). The slips 12 may be actuable by hydraulic or pneumatic force. An external hydraulic or pneumatic source may be connected to the spear 66 to actuate the slips 12. The hydraulic or pneumatic force may be created by fluid behind a piston within a cylinder. When the slips 12 are unactuated, the casing is moveable axially and rotationally relative to the spear 66.

The cementing/circulating tool 2 is disposed within the spear 66 and is rigidly fixed therein. The tool 2 has a shoulder 26 disposed around the outer diameter of the tubular body 13. When the tool 2 and spear 66 are inserted into the casing, the shoulder rests upon the casing in the same manner as the landing plate 34 rests on the casing, as described in relation to FIGS. 1-5.

In the operation of the spear 66 with the tool 2, the top drive (not shown), which is connected to the upper end of the sub 9, is lowered along with the spear 66 and tool 2 so that a lower portion of the spear 66 and tool 2 are located within the casing. The slips 12 are actuated to grippingly and sealingly engage the inner diameter of the casing. The only substantial difference in operation between the torque head 220 and the spear 66 involves the gripping of the casing (the spear 66 grips the inner diameter of the casing rather than the outer diameter of the casing); therefore, the remainder of the operation of the spear 66 with the tool 2 and casing is the same as described below in relation to FIGS. 1-5.

In operation, referring to FIGS. 1-5, an upper end of the circulating head 3 is threaded onto a lower end of the packer mandrel 20 so that the assembly shown by the solid lines in FIG. 2 is formed. The casing 300 has an earth removal member, preferably a cutting structure such as a drill shoe or drill bit, operatively connected to its lower end for use in drilling with casing. The casing 300 may be initially located on a rack (not shown) or pickup/lay down assembly (not shown) outside of a drilling rig (not shown). The casing 300 may be transported, in one embodiment by a single joint elevator on cable bails, to a location substantially center of a well above a hole (not shown) in a rig floor (not shown) of the drilling rig. The single joint elevator is used to grippingly engage the casing 300 so that the casing 300 is longitudinally fixed below the tool 2 and the torque head 220. The top drive 200, tool 2, and torque head 220 are lowered toward the casing 300 by the draw works.

As the torque head 220 is lowered, the casing 300 is located within the torque head 220 between the torque head 220 and the tool 2, as shown in FIG. 3. The torque head 220 is lowered until the lower plate 40 of the landing plate 34 hits the upper end of the casing coupling 305, as depicted in FIG. 3. Fluid is then introduced through the actuator 121 by the fluid hose (not shown). The actuator 121 forces the springs 62 to contract from the biased position, thus forcing the slips 135 down the incline of the bowl 125. The slips 135 are thereby actuated to grippingly and sealingly engage the casing 300.

The tool 2 is then activated to seal an annular space between an outer diameter of the packer mandrel 20 and an inner diameter of the casing 300 to prevent fluid flow through the annular space while circulating fluid. The cup packer 25 energizes the packer 65, and the packer 65 expands to sealingly engage the inner diameter of the casing 300. FIG. 3 shows the torque head 220 grippingly engaging the casing 300 and the tool 2 sealingly engaging the casing 300.

In this position, an assembly 402 including the tool 2, torque head 220, and casing 300 is ready to lower the casing 300 into the formation to form the wellbore (not shown). The top drive 200 (see FIG. 2) rotates the assembly 402 relative to the top drive 200. At the same time, drilling fluid is circulated through the top drive 200, through the tool 2, and out through the casing 300. The fluid flows around the lower end of the casing 300 and up through an annular space between the outer diameter of the casing 300 and the formation. Drilling fluid is circulated while drilling into the formation to form a path for the casing 300 in the formation and to clear the inner diameter of the casing 300 of mud and other substances to facilitate the drilling process.

Once the casing 300 is drilled to the desired depth within the formation, a spider (not shown) is actuated to grippingly engage the outer diameter of an upper portion of the casing 300, so that the casing 300 is prevented from moving further downward into the wellbore. The slips 135 of the torque head 220 are then released from gripping engagement with the outer diameter of the casing 300, and the packer 65 of the tool 2 is released from sealing engagement with the inner diameter of the casing 300. An interlock system such as the system disclosed in U.S. Patent Application Publication No. 2002/0170720, filed by Haugen on May 17, 2001, which is herein incorporated by reference in its entirety, may be used with the present invention to ensure that either the spider or the torque head 220 is grippingly engaging the casing 300 at all times. The casing 300 is left within the wellbore while the torque head 220 and the rigidly connected tool 2 are lifted from the wellbore by the draw works.

Additional casings may then be drilled into the formation to form a cased wellbore of a desired depth. The additional casings typically have male threads disposed at their upper and lower ends (rather than a cutting structure disposed at the lower end, such as in the casing 300), so that a lower end of a coupling such as the casing coupling 305 with female threads disposed at both ends is threaded onto the male threads on the upper end of each casing.

Each additional casing may be transported to well center from the rack or pickup/lay down machine and inserted into the torque head 220 between the torque head 220 and the tool 2, as described above in relation to casing 300. The slips 135 of the torque head 220 are actuated into gripping engagement with the outer diameter of the additional casing, and the packer 65 of the tool 2 is deployed into sealing engagement with the inner diameter of the additional casing.

The additional casing is lowered by the draw works toward the casing 300 already disposed within the wellbore. The top drive 200 is then actuated to rotate the additional casing relative to the casing 300. The casing 300 is rotationally and axially fixed at this time due to the gripping engagement of the spider. A threaded connection is made up between the male threads of the additional casing string and the female threads of the casing coupling 305 by the rotational forces imparted by the top drive 200. Next, the casing comprising the casing 300 and the additional casing is released from the spider and lowered (possibly while rotating) into the formation as described above in relation to drilling the casing 300 into the formation. This process is repeated with any number of additional casings.

After a certain amount of additional casings are coupled to one another and lowered into the formation, a cementing operation must often be performed to prevent the formation from collapsing into the casing. When it is desired to drill the last casing into the formation before cementing the annular space between the casing and the formation to form a cased wellbore, the torque head 220 and the tool 2 are removed from the wellbore, and the second-to-last casing before the cementing operation is left within the wellbore suspended by the spider.

Referring to FIG. 2, the circulating head 3 shown by the solid lines is unthreaded from the packer mandrel 20. The cementing head 4, which is shown by the dotted lines, is then threaded onto the lower end of the packer mandrel 20. The last casing 400 (see FIG. 4) may be picked up from the rack or pickup/lay down machine and transported to the well center. The torque head 220 and the tool 2 are then lowered by the draw works so that the casing 400 is inserted into the torque head 220 between the torque head 220 and the tool 2.

Once the torque head 220 and the tool 2 are lowered onto the casing 400 so that the lower plate 40 of the tool 2 is touching the upper end of the casing coupling 405, the slips 135 are actuated to grippingly engage the outer diameter of the casing 400, as described above in relation to the casing 300. Moreover, the packer 65 of the tool 2 is deployed to sealingly engage the inner diameter of the casing 400 as described above in relation to the casing 300.

After the packer 65 and slips 135 engage the casing 400, the casing 400 is rotationally and axially fixed within the torque head 220. The casing previously disposed within the wellbore is rotationally and axially fixed within the spider (not shown) at well center. The draw works is lowered so that the casing 400 rests on the casing previously disposed within the wellbore, and the threadable connection between the casings is made up by rotation imparted upon the casing 400 by the top drive 200.

The spider is then released from gripping engagement with the additional casing previously disposed in the wellbore, so that the casing 400 with the additional casing connected thereto is moveable axially and rotationally within the wellbore. Circulating fluid is introduced into the top drive in the same manner as described above, and the fluid travels through the tool 2, through the casing 400, through the additional casings, through the casing 300 with the cutting structure attached thereto, and up through the annular area between the casing 400, 300 and the formation. At this point, the flapper valves (not shown) of the cement plugs 75, 80 are biased in the open position by the slidable mandrel 70, so that fluid is flowable through the cement plugs 75, 80 to circulate around the casing 400, 300. The collet fingers 71 (shown in FIG. 4) of the collet 72, which is located on the lower cement plug 75, are initially engaging the upper cement plug 80 to hold the two cement plugs 75, 80 together.

While the drilling fluid is introduced into the top drive 200, drilling into the formation to form the wellbore is accomplished by the top drive 200 rotating the torque head 220, tool 2, and casing 400, 300, which are all substantially axially and rotationally fixed relative to one another. Simultaneously, the draw works lowers the top drive 200, torque head 220, tool 2, and casing 400, 300 into the formation. After the casing 400, 300 has been drilled to the desired depth within the formation, the rotational and axial movement of the casing 400, 300 is halted. Also, the drilling fluid is no longer introduced into the top drive 200.

After the drilling operation is halted, the cementing operation begins. The lower cement plug 75 is launched before cement is introduced into the casing string 400, 300 to clean out the inner diameter of the casing string 400, 300. To launch the lower cement plug 75, hydraulic fluid is introduced through a hydraulic hose (not shown) into the lower port 60 (see FIGS. 1 and 4). Fluid introduced behind the slidable mandrel 70 forces the slidable mandrel 70 up with respect to the plug release mandrel 85 and the plug release body 44. The slidable mandrel 70 moves upward through the annular space 42 to the upper port 55. As the slidable mandrel 70 moves up, the flapper valve of the lower cement plug 75 closes. The collet fingers 71 of the collet 72 are released from engagement with the upper cement plug 80 so that the lower cement plug 75 is axially moveable with respect to the upper cement plug 80.

Figure 4:
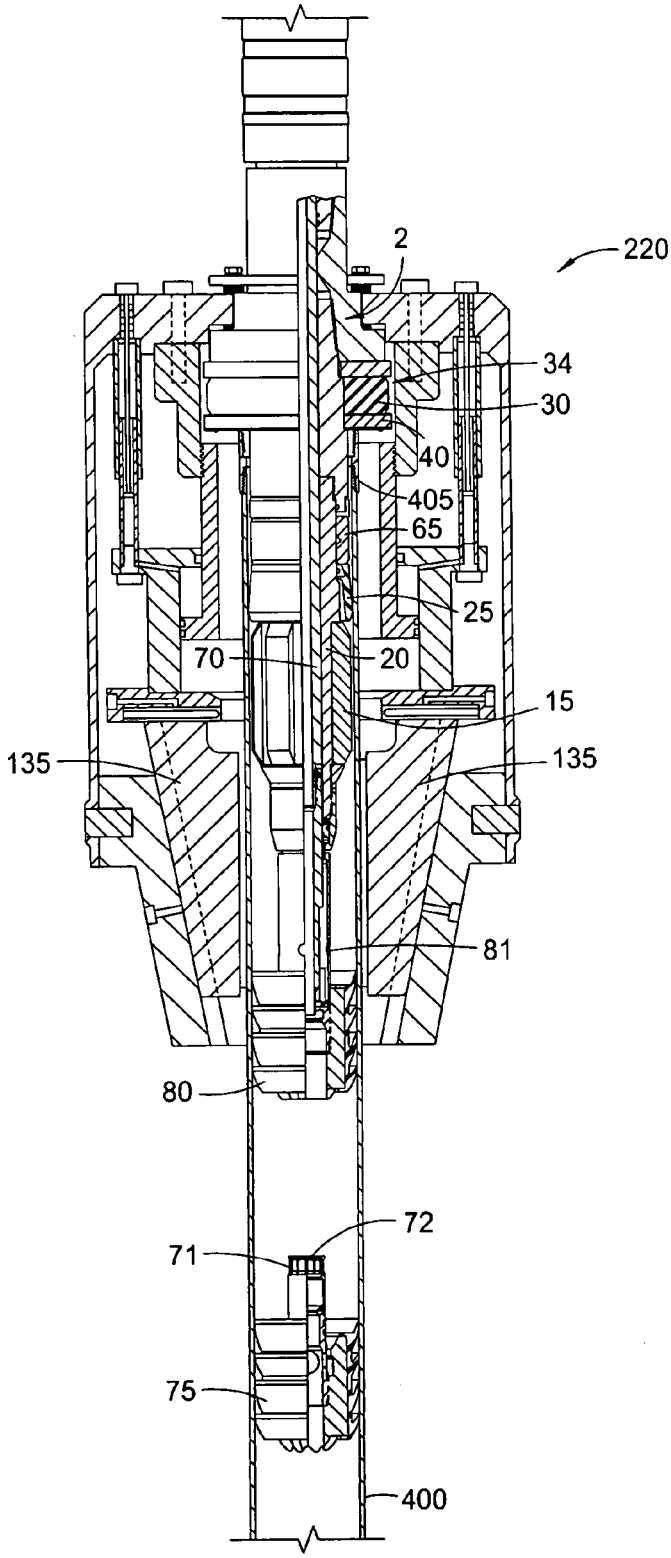
FIG. 4 is a sectional view of the circulating/cementing tool located within a torque head. The torque head is grippingly engaging casing disposed therein. The circulating/cementing tool is used as a cementing tool. A lower cement plug is launched within the casing.

Cement is then introduced through the cement line 205 (see FIG. 2) into the tool 2. The cement flows through the upper cement plug 80, but is prevented from flowing through the lower cement plug 75 because the flapper valve of the lower cement plug 75 is in the closed position. A volume of cement necessary to fill the annular space between the casing 400, 300 and the formation is introduced through the upper cement plug 80 and behind the lower cement plug 75 to force the lower cement plug 75 downward within the casing string 400, 300 until the lower cement plug 75 is hindered from further downward movement by a drill shoe or drill bit (not shown) disposed at the lower end of the casing 400, 300. FIG. 4 shows the lower cement plug 75 launched within the casing 400, 300. Cement is located between the lower cement plug 75 and the upper cement plug 80.

After the desired volume of cement has been introduced behind the lower cement plug 75, the upper cement plug 80 is launched. To launch the upper cement plug 80, fluid is introduced through the hydraulic hose (not shown), into the middle port 55, and behind the slidable mandrel 70. The slidable mandrel 70 moves further upward within the annular space 42 to the upper port 50, causing the connection (preferably a collet) of the upper cement plug 80 to the tool 2 to release.

Figure 5:
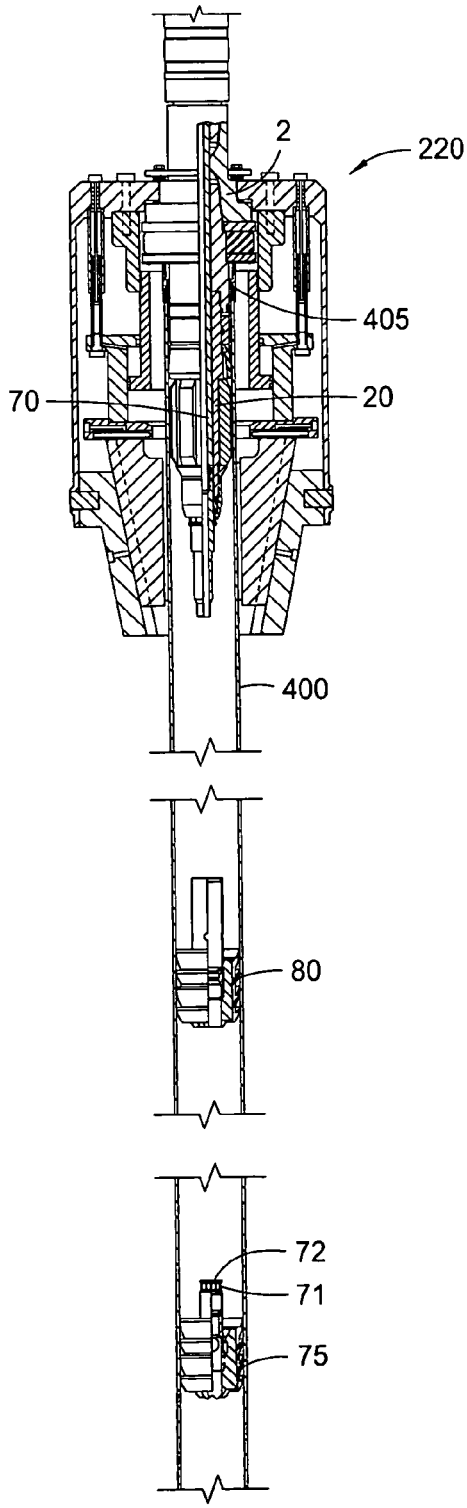
FIG. 5 shows a sectional view of the circulating/cementing tool used as a cementing tool within a torque head. The lower cement plug and an upper cement plug are launched.

As the upper cement plug 80 travels downward within the casing string 400, 300, the flapper valve within the upper cement plug 80 closes. Fluid behind the upper cement plug 80 forces the upper cement plug 80 downward within the casing 400, 300. The upper cement plug 80 continues downward within the casing 400, 300 until it is stopped from further downward movement by the cement between the cement plugs 80, 75. FIG. 5 shows the upper cement plug 80 launched behind the lower cement plug 75.

The increasing pressure produced when the lower cement plug 75 lands on the drill shoe and stops moving causes the rupture disk (not shown) to burst so that the cement between the cement plugs 75, 80 is free to travel through the lower cement plug 75, through a lower portion of the inner diameter of the casing 400, 300, and up through the annular space between the outer diameter of the casing 400, 300 and the wellbore formed in the formation. The cement fills the annular space between the outer diameter of the casing 400, 300 and the wellbore formed in the formation to form a cased wellbore. Fluid flow through the cement line 205 is stopped by closing the check valve 210, and the cement is allowed to cure at hydrostatic pressure.

At the end of the cementing operation, the slidable mandrel 70 may be returned to its original location directly above the lower port 60 for further operations by introducing fluid through the upper port 50. Fluid flows through the upper port 50, into the annular space 42, and in front of the slidable mandrel 70 to move the slidable mandrel 70 downward. In an alternate embodiment, the apparatus and method of the present invention are equally effective when only a single cement plug is launched such as the single direction top plug shown and described in the U.S. patent application Ser. No. 10/767,322 filed by applicants on Jan. 29, 2004, which is herein incorporated by reference in its entirety.

The slips 135 are next unactuated so that they are released from gripping engagement with the outer diameter of the casing 400, 300, and the packer 65 is released from sealing engagement with the inner diameter of the casing 400, 300. The cement in the annular space between the casing 400, 300 and the formation holds the casing 400, 300 in place within the wellbore while the torque head 220 and the tool 2 are pulled upward out of the wellbore by the draw works. A circulating head may be threaded onto the packer mandrel 20 if further drilling with casing operations are desired. When performing further drilling with casing, the cement plugs 75, 80 and the drill shoe or other earth removal member at the lower end of the casing 300 may be drilled through by an earth removal member such as a cutting structure operatively connected to a lower end of a subsequent casing when the subsequent casing with the cutting structure attached thereto is inserted through the inner diameter of the casing 400, 300. In the alternative, the cement plugs 75, 80 and the earth removal member may be retrieved from the wellbore and a subsequent casing drilled through the casing 300, 400. The process outlined above may be repeated to drill the subsequent casings into the formation and cement the drilled casings into the wellbore.

In the above-described embodiments, the cementing/circulating tool 2 may include several subs/mandrels connected together, as described above. In the alternative, the cementing/circulating tool 2 may include one continuous tubular body.

In the above-described process, the slidable mandrel 70 is slidable due to hydraulic force, but it is also within the scope of the invention for the slidable mandrel 70 to be moveable upward by pneumatic force, electronic means, threadable connections between the slidable mandrel 70 and the adjacent mandrels 44 and 6, a vacuum system, or any other suitable mechanism.

Additionally, although the above description of embodiments shown in FIGS. 1-6 relate to drilling while rotating the entire casing 300, 400, only a portion of the casing 300, 400 such as the drill bit may be rotated by a mud motor, for example, while lowering the casing 300, 400 into the formation to form the wellbore. It is also contemplated that the casing 300, 400 may merely be pushed or lowered into the formation while circulating drilling fluid therethrough without rotating any portion of the casing to form the wellbore.

In another aspect of this invention, a joint compensator is disclosed. Generally, a joint compensator is used for compensating the weight of a first joint and at least one subsequent joint, whereby the first joint is supported above the at least one subsequent joint. Typically, the joint compensator comprises a body interconnectible between the first joint and a moving apparatus for moving the first joint. The body includes a supporting apparatus for supporting the first joint above the at least one subsequent joint and for providing support of the first joint as it moves with respect to the at least one subsequent joint. The supporting apparatus compensates for weight of the first joint as it moves. The supporting apparatus includes a piston movably mounted in a hollow cylinder with an amount of gas above the piston and an amount of gas below the piston. An exemplary joint compensator is described in U.S. Pat. No. 5,850,877, issued to Albright et al. on Dec. 22, 1998, which is herein incorporated by reference in its entirety.

Figure 7:
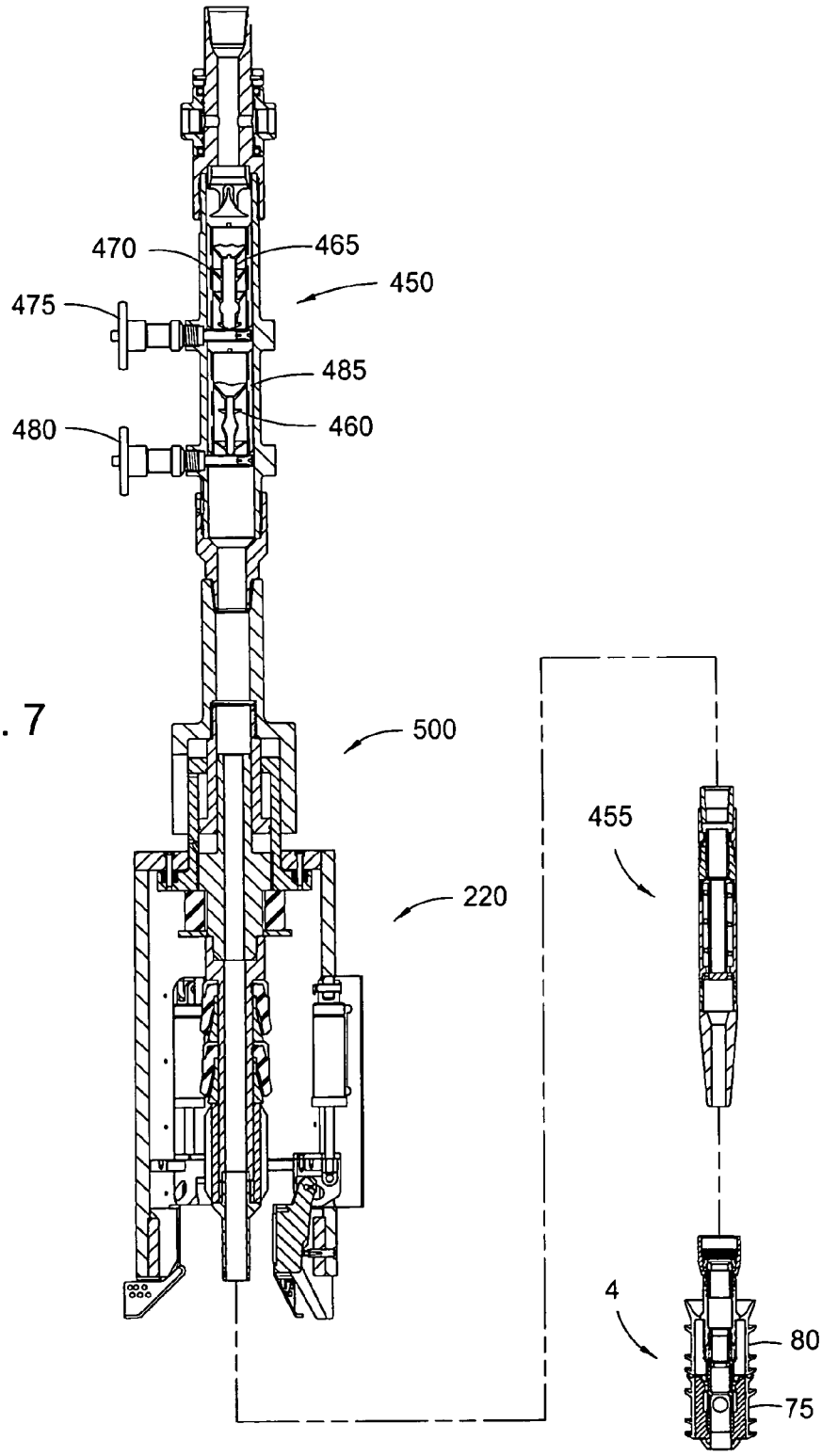
FIG. 7 is a sectional view of a system for use with a compensator apparatus of the present invention, including a launching head, a compensator apparatus, a torque head, and a cement head.

FIG. 7 is a sectional view of the system for use with the present invention, including a launching head 450, a compensator apparatus 500, the torque head 220 and the cementing head 4. The system illustrated in FIG. 7 operates in a similar manner as described above. The launching head 450 is used to actuate the cementing head 4 during the cementing operation.

During drilling and circulation of the casing, the cement plugs are not located on the end of the circulation tool. The launching head 450 permits fluid to pass through during the circulating and drilling operations. A one-way valve such as a check valve 455, preferably located at a lower end of the circulation tool, prevents fluid flow in the opposite direction. Fluid flows through a bypass passageway 470 formed in an assembly housing 485. The bypass passageway 470 allows the fluid to be communicated through the launching head 450 without affecting upper and lower darts 465, 460. As illustrated in FIG. 7, an upper dropper 475 holds the upper dart 465 in place and the lower dart 460 is held in place by a lower dropper 480. The upper and lower droppers 475, 480 may be manually or remotely operated.

As previously described, the upper and lower cement plugs 80, 75 are used during the cementing operation. To release the lower cement plug 75, the lower dropper 480 is actuated, thereby removing a releasable connection such as a pin (not shown) that holds the lower dart 460 in place. Subsequently, fluid pumped through the launching head 450 causes the lower dart 460 to move axially downward through the compensator apparatus 500 and the torque head 220 until it contacts the lower cement plug 75. In turn, the cement plug 75 is released, thereby initiating the cementing operation.

After the cement has been pumped through the system as described above, the upper dart 465 is released in a similar manner as the lower dart 460. Particularly, the upper dropper 475 releases the upper dart 465 to move through the system until it contacts the upper cement plug 80. Thereafter, the upper cement plug 80 is released to complete the cementing operation. In this manner, the torque head 220 is integrated with the launching head 450 and the cementing head 4 (as well as the circulating head 3) of the circulating/cementing tool 2, thereby providing a system capable of running casing as well as permitting a circulating (fill-up) and a cementing operation. The torque head 220 integrated with the launching head 450 and the circulating/cementing tool 2 also allows reciprocation (axial movement) of casing in the well.

In an alternate embodiment, other devices including but not limited to balls or free falling darts having no fins to pump them down may be used to launch both the upper and lower cement plugs 75, 80. Additionally, only a single top plug may be utilized with the present invention such as the single direction top plug shown and described in U.S. patent application Ser. No. 10/767,322 filed by applicants on Jan. 29, 2004, which was above incorporated by reference.

Figure 8:
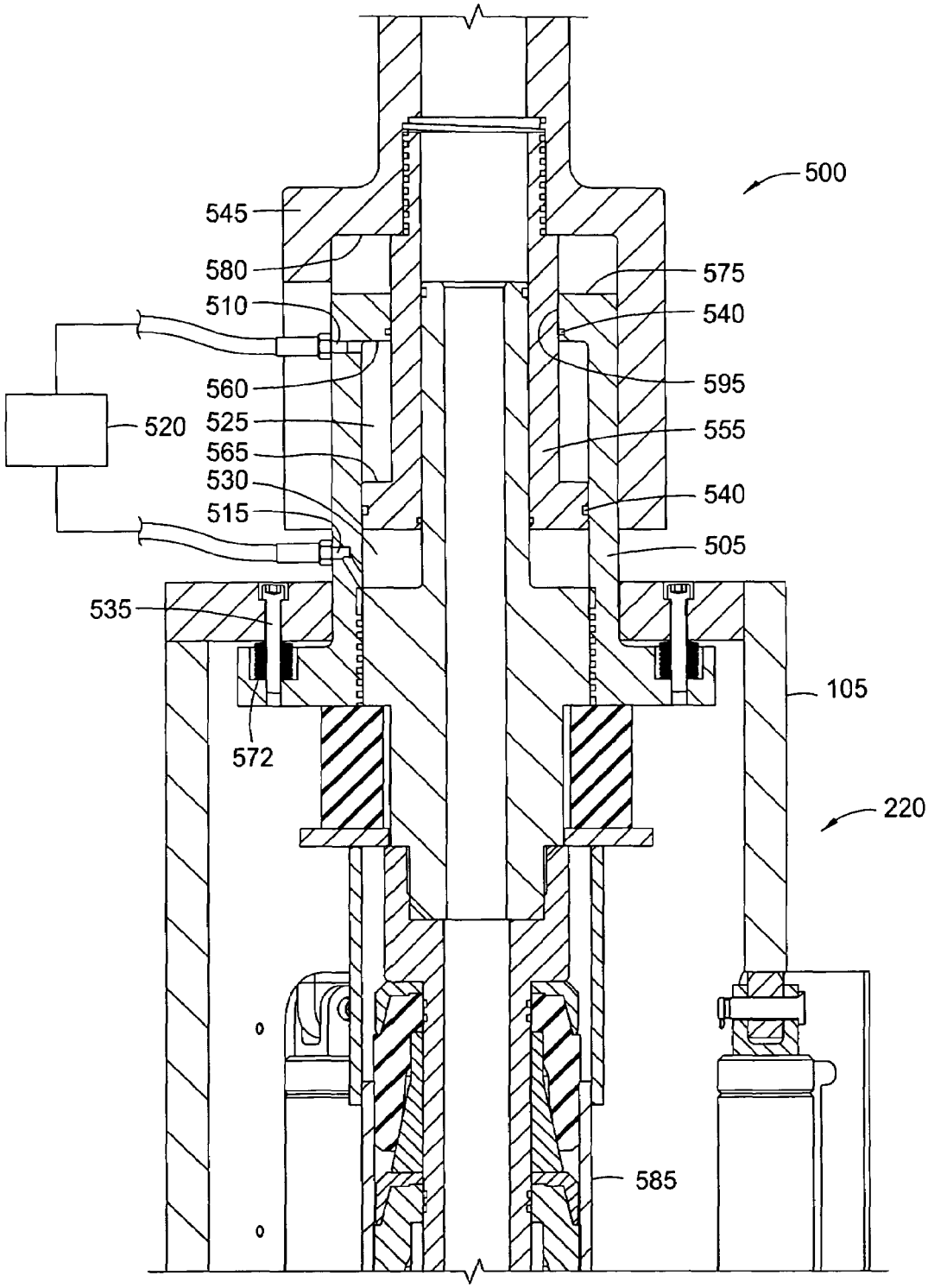
FIG. 8 is an enlarged view of the compensator apparatus.

FIG. 8 is an enlarged view of the compensator apparatus 500. Generally, the compensator apparatus 500 compensates for the weight of a casing 585, which may include a casing section or a casing string including two or more casing sections connected (preferably threadedly connected) to one another, and permits the torque head 220 to move axially during the operation. The compensator apparatus 500 includes an apparatus housing 545 that connects the compensator apparatus 500 to the launching head 450. The apparatus housing 545 includes a housing surface 580.

The compensator apparatus 500 further includes a spline mandrel 555 operatively attached to the interior portion of the apparatus housing 545. The spline mandrel 555 includes a mandrel surface 565.

The spline mandrel 555 and a cylinder 505 define an upper chamber 525. An upper port 510 formed in the housing 545 permits fluid communication in and out of the upper chamber 525. As shown in FIG. 8, the cylinder 505 is axially movable within the compensator apparatus 500. The cylinder 505 includes an upper surface 575 and a lower surface 560. Additionally, the cylinder 505 includes a cylinder face 595 that is operatively attached to the spline mandrel 555 to form a torque connection, thereby allowing torque from the top drive 200 (shown in FIG. 2) to be transmitted through the compensator apparatus 50Q to the torque head 220. The torque connection is maintained throughout the axial movement of the cylinder 505. In other words, a torque may be transmitted from the top drive 200 to the torque head 220 throughout the operation. The torque connection may be constructed and arranged from a spline arrangement, a key and groove arrangement, or any other form of torque connection known in the art.

A lower chamber 530 is formed between the spline mandrel 555 and the cylinder 505. One or more sealing members 540 disposed between the spline mandrel 555 and the cylinder 505 provide a fluid tight relationship therebetween. The lower chamber 530 is in fluid communication with the upper chamber 525 through a valve assembly 520. Fluid flows in and out of the lower chamber 530 through a lower port 515 formed in the housing 545. The lower port 515 and upper port 510 are connected to the valve assembly 520 to form a circuit. The valve assembly 520 may be located near the rig floor and may be manually or remotely operated to adjust the fluid pressure in the upper and lower chambers 525, 530, thereby extending or retracting the cylinder 505.

The cylinder 505 is mechanically attached to the housing 105 of the torque head 220. As shown in FIG. 8, one or more bolts 535 may be used to secure the housing 105 to the compensator apparatus 500. Additionally, one or more biasing members 572 are disposed on the one or more bolts 535. Generally, the one or more biasing members 572 compensate for misalignment between the compensating apparatus 500 and the torque head 220. As shown on FIG. 8, the biasing members 572 comprises belleville washers; however, other forms of biasing members 572 may be employed so long as they are capable of compensating for misalignment between the compensating apparatus 500 and the torque head 220.

The compensator apparatus 500 is useful in making up and breaking out threadable connections between tubulars, including threadable connections between casing sections. The compensator apparatus 500 allows axial movement upward and downward of the torque head 220 and casing 585 relative to the top drive 200.

Figure 9:
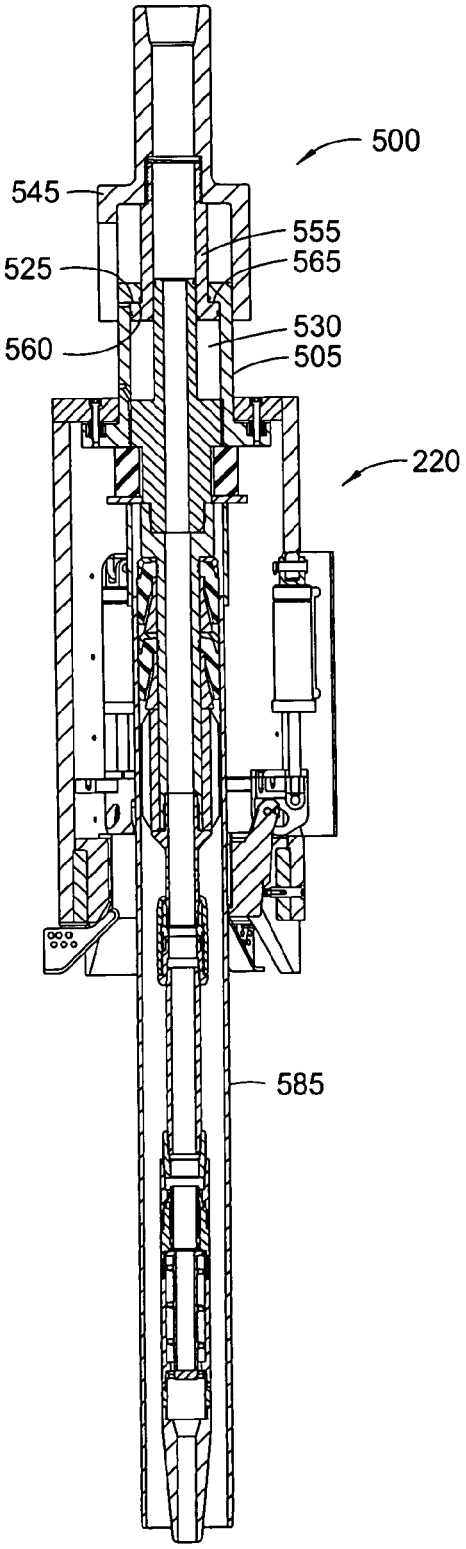
FIG. 9 is a sectional view illustrating the torque head in an extended downward position.

FIG. 9 is a sectional view illustrating the torque head 220 in an extended downward position. As shown, the cylinder 505 and the torque head 220 have moved axially downward relative to the apparatus housing 545 and spline mandrel 555. Fluid from the upper chamber 525 is communicated through the valve assembly 520 (shown in FIG. 8) into the lower chamber 530, thereby urging the cylinder 505 axially downward until the cylinder lower surface 560 contacts the mandrel surface 565. In this position, the torque head 220 is fully extended axially downward to permit the torque head 220 to pick up the casing 585. Thereafter, the torque head 220, casing 585, and cylinder 505 move axially upward as shown in FIG. 10.

Figure 10:
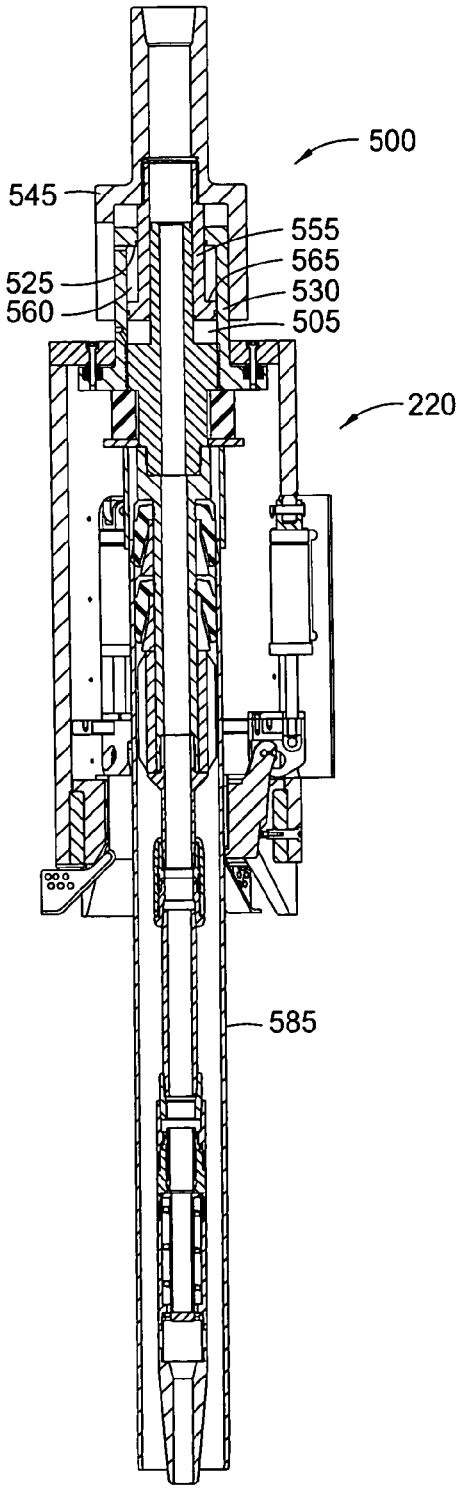
FIG. 10 is a sectional view illustrating the torque head positioned prior to the threading operation.

FIG. 10 is a sectional view illustrating the torque head 220 positioned prior to the threading operation. As shown, the cylinder 505, the torque head 220, and the casing 585 have moved axially upward relative to the apparatus housing 545 and spline mandrel 555. Particularly, fluid from the lower chamber 530 is communicated through the valve assembly 520 (shown in FIG. 8) into the upper chamber 525, thereby urging the cylinder 505 axially upward. In this position, the torque head 220, and casing 585 may move axially downward relative to the top drive during the threading operation.

Figure 11:
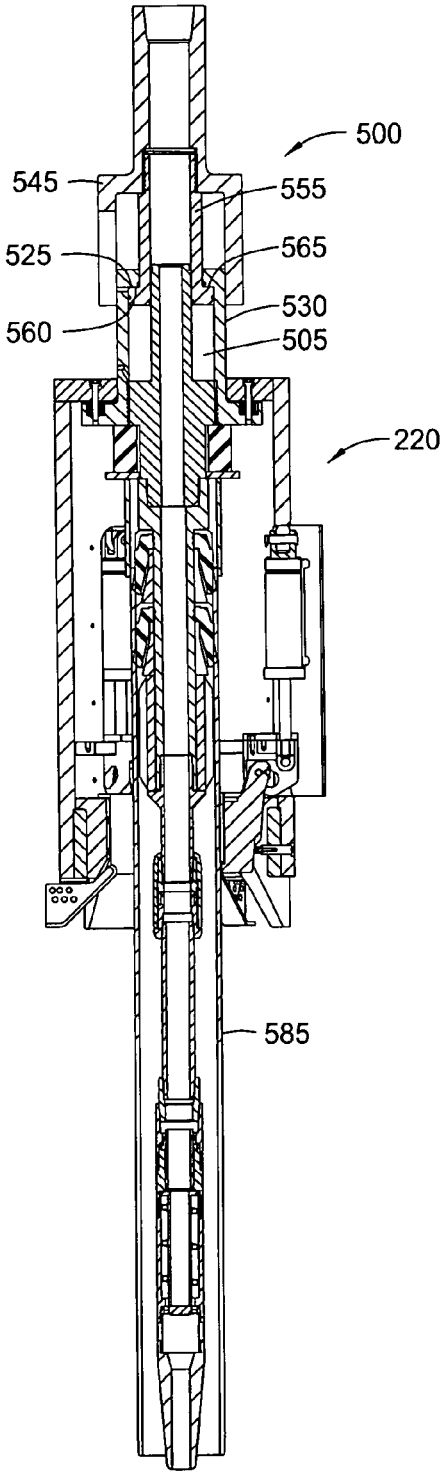
FIG. 11 is a sectional view illustrating the torque head positioned after the threading operation.

FIG. 11 is a sectional view illustrating the torque head 220 positioned after the threading operation. As shown, the cylinder 505, the torque head 220, and the casing 585 have moved axially downward relative to the apparatus housing 545 and spline mandrel 555. Fluid from the upper chamber 525 is communicated through the valve assembly 520 into the lower chamber 530, thereby urging the cylinder 505 axially downward relative to the spline mandrel 555. In other words, as the casing 585 is threaded into the lower casing (not shown) any axial movement, for example due to the threading engagement, is compensated by the movement of the torque head 220 and the cylinder 505, thereby minimizing tension created during the threading operation between the torque head 220 and the top drive 200 (shown in FIG. 2). In a similar manner, the breaking out process may be accomplished by reversing the order of operation as previously discussed relating to FIGS. 9-11.

Furthermore, the torque head 220 is positioned to circulate fluid through the entire string of casing (not shown). In this position, the torque head 220 may also compensate for any axial force caused by the fluid. In this respect, the torque head 220 may move axially upward to relieve an upward axial force created by the fluid pressure from the circulating fluid.

Figure 12:
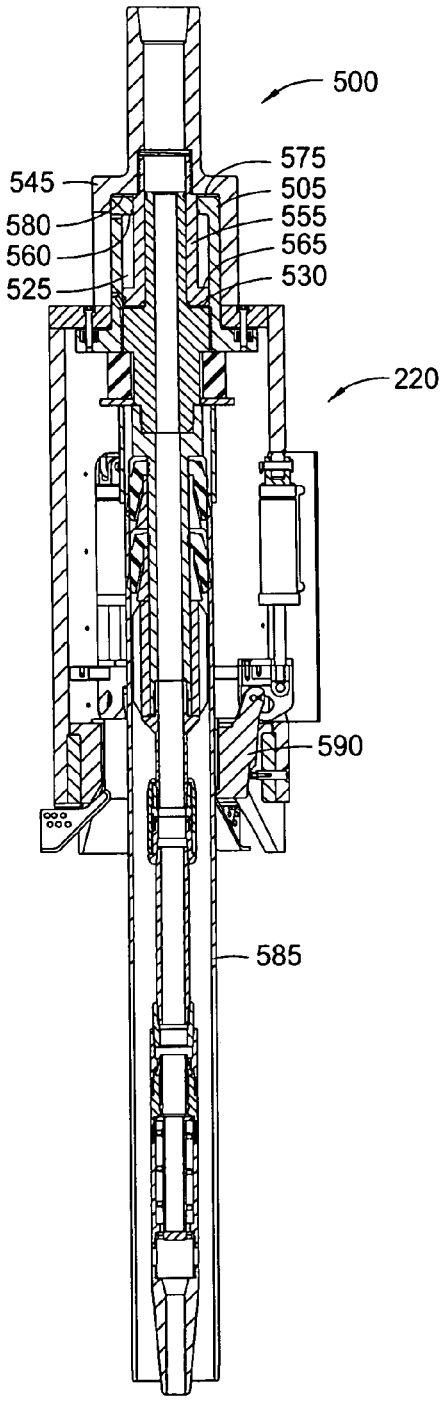
FIG. 12 is a sectional view illustrating the torque head in an extended upward position.

FIG. 12 is a sectional view illustrating the torque head 220 in a fully extended upward position. As shown, the cylinder 505, the torque head 220, and casing 585 have moved axially upward relative to the apparatus housing 545 and spline mandrel 555. Particularly, fluid from the upper chamber 525 is communicated through the valve assembly 520 into the lower chamber 530, thereby urging the cylinder 505 axially upward until the cylinder upper surface 575 contacts the housing surface 580. If the one or more slips 135 of the torque head 220 become stuck to the casing 585 during the operation of the torque head 220, an upward axial force on the apparatus housing 545 may be translated to the torque head 220 to release the slips 135 from the casing 585.

Figure 13:
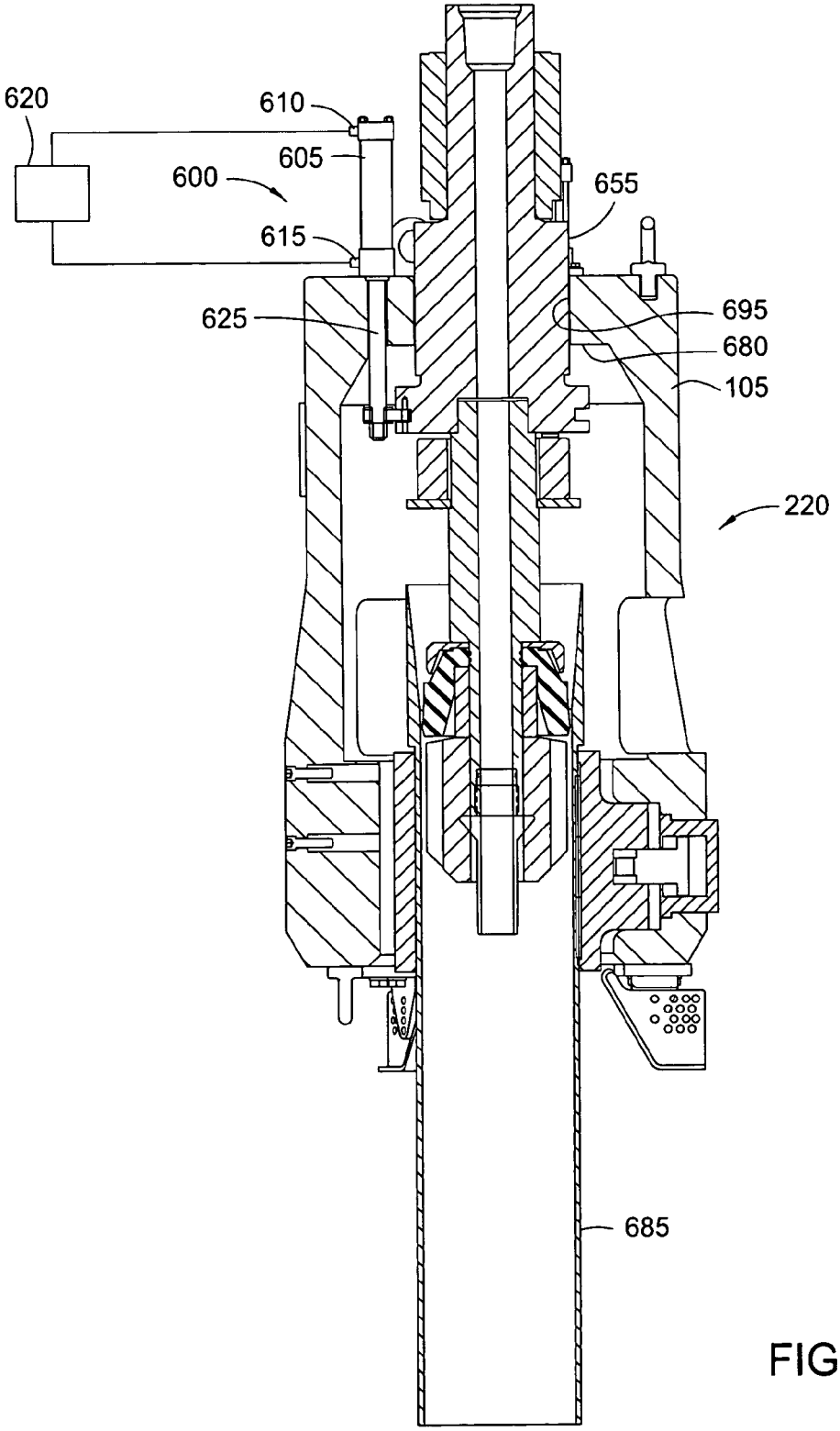
FIG. 13 is a sectional view illustrating a compensator apparatus positioned prior to the threading operation.

FIG. 13 is a sectional view illustrating an alternate embodiment of a compensator apparatus 600 positioned prior to the threading operation. In a similar manner as described above in relation to the compensator apparatus 500 of FIGS. 7-12, the compensator apparatus 600 compensates for the weight of casing 685 and permits the torque head 220 to move axially during the operation of the system.

The compensator apparatus 600 includes one or more fluid-operated cylinders 605 mechanically attached to the housing 105 of the torque head 220.

The fluid-operated cylinders 605 may be manually or remotely operated. Each of the cylinders 605 includes a rod 625 that extends into the housing 105. As illustrated, the lower end of the rod 625 is mechanically attached to a spline mandrel 655. The fluid cylinders 605 further include an upper port 610 and a lower port 615 which are in fluid communication with a valve assembly 620. The valve assembly 620 may be located near the rig floor and may be manually or remotely operated to adjust the fluid pressure in the cylinders 605, thereby extending or retracting the rods 625. The extension of the rods 625 of the cylinders 605 moves the torque head 220 axially upward relative to the spline mandrel 655. Conversely, the retraction of the rods 625 moves the torque head 220 axially downward relative to the spline mandrel 655.

The housing 105 of the torque head 220 is capable of moving relative to the spline mandrel 655 in the embodiment shown in FIG. 13. The housing 105 is also moveable independent of the top drive 200.

As shown in FIG. 13, the housing 105 of the torque head 220 includes a housing face 695 and a housing surface 680. The housing face 695 is operatively engaged to the spline mandrel 655 to form a torque connection, thereby allowing torque to be transmitted from the top drive 200 (shown in FIG. 2) through the compensator apparatus 600 to the torque head 220. The torque connection is maintained throughout the axial movement of the torque head 220. In other words, a torque may be transmitted from the top drive 200 to the torque head 220 throughout the operation, including the threading and the drilling operation. The torque connection may be constructed and arranged from a spline arrangement as shown, a key and groove arrangement, or any other type of torque connection known in the art.

As illustrated on FIG. 13, the torque head 220 may move axially up or down depending on the desired function of the compensator apparatus 600. The torque head 220 in this position may be utilized to connect the casing 685 to a subsequent lower string of casing (not shown) during the threading operation. Thereafter, the torque head 220 may move axially downward as illustrated in FIG. 14.

Figure 14:
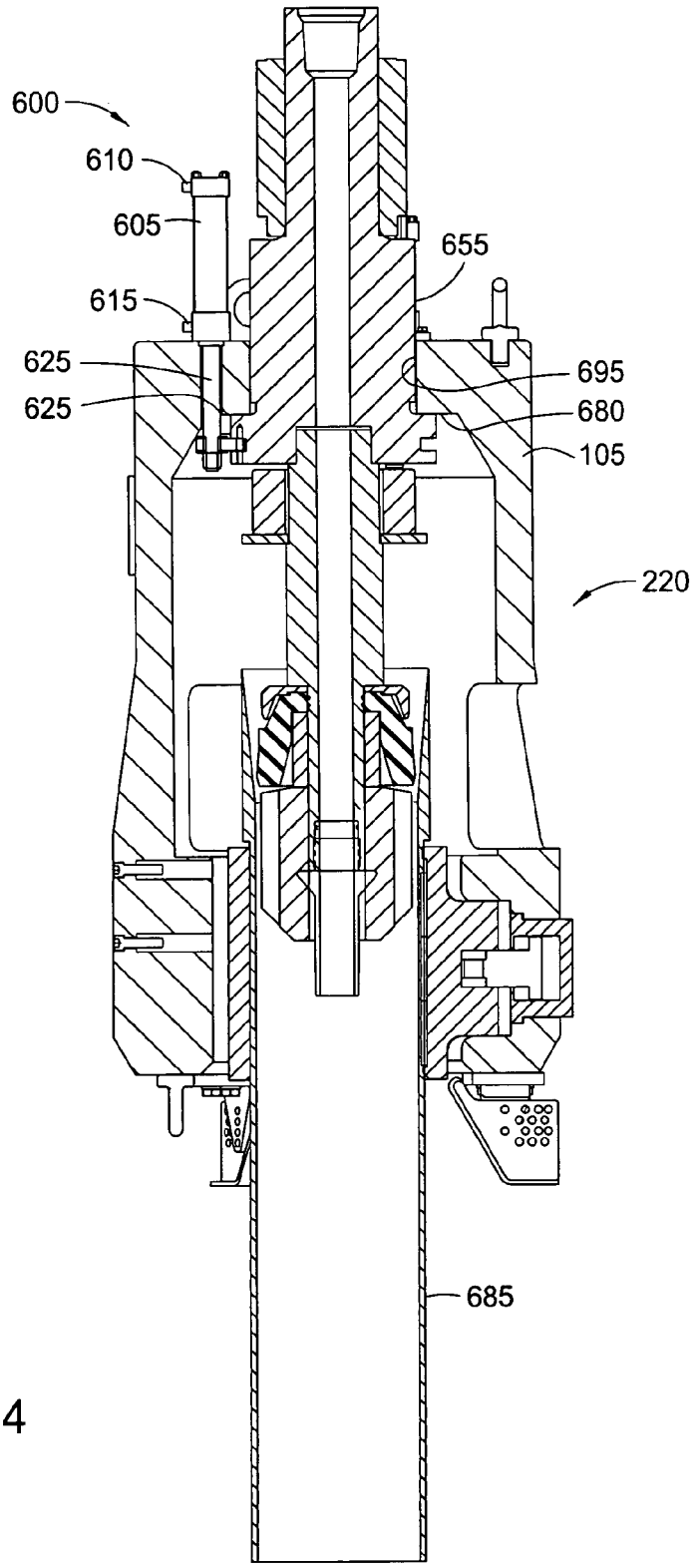
FIG. 14 is a sectional view illustrating the torque head in an extended downward position.

FIG. 14 is a sectional view illustrating the torque head 220 in a fully extended downward position, which is the typical position of the torque head 220 after the threading operation. As shown, the one or more cylinder rods 625 have retracted, causing the torque head 220 and the casing 685 to move axially downward relative to the spline mandrel 655 until a mandrel surface 665 contacts the housing surface 680. Fluid from the upper port 610 is communicated through the valve assembly 620 (shown in FIG. 13) into the lower port 615, thereby urging the rod 625 axially upward relative to the spline mandrel 655. In other words, as the casing 685 is threaded into the subsequent lower casing (not shown), any axially downward movement due to the threading engagement is compensated by the downward movement of the torque head 220 and the one or more cylinders 605, thereby minimizing tension created during the threading operation between the torque head 220 and the top drive 200 (shown in FIG. 2). In a similar manner, the breaking out of the threaded connection may be accomplished by reversing the order of operation.

As illustrated in FIG. 14, the torque head 220 is fully extended. In this arrangement, the torque head 220 is positioned to circulate fluid through the entire string of casing (not shown). In this position, the torque head 220 may also compensate for any axial force caused by the fluid. In this respect, the torque head 220 may move axially upward to relieve an upward axial force created by the fluid pressure from the circulating fluid. Furthermore, the fully extended torque head 220 may be utilized to pick up another casing similar to casing 685. Thereafter, the torque head 220 and the casing 685 may move axially upward as shown in FIG. 15.

Figure 15:
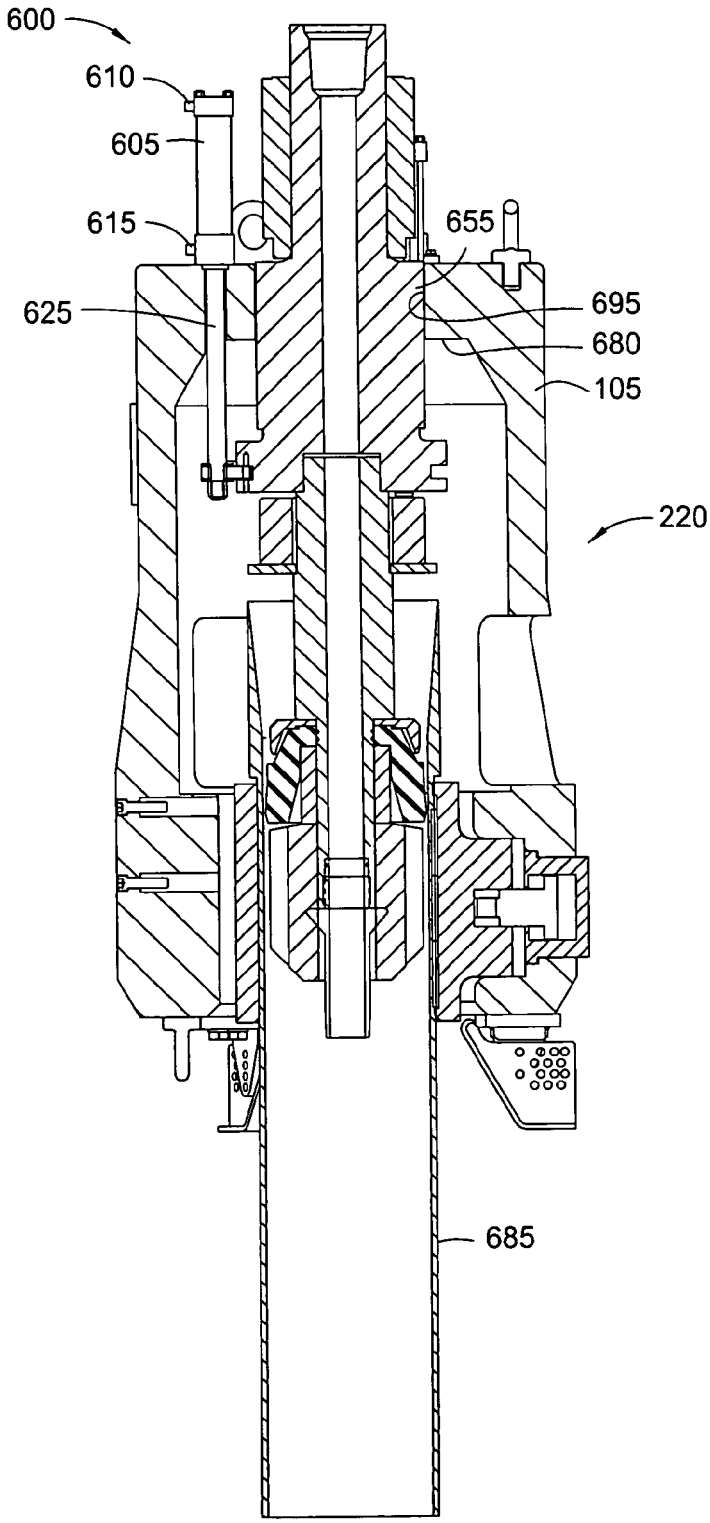
FIG. 15 is a sectional view illustrating the torque head in an extended upward position.

FIG. 15 is a sectional view illustrating the torque head 220 in a fully extended upward position. As shown, the rod 625 has extended, thereby causing the torque head 220 and casing 685 to move axially upward relative to the spline mandrel 655. Fluid from the lower port 615 is communicated through the valve assembly 620 (shown in FIG. 13) into the upper port 610, thereby extending the rod 625 into the cylinder 605.

Figure 16:
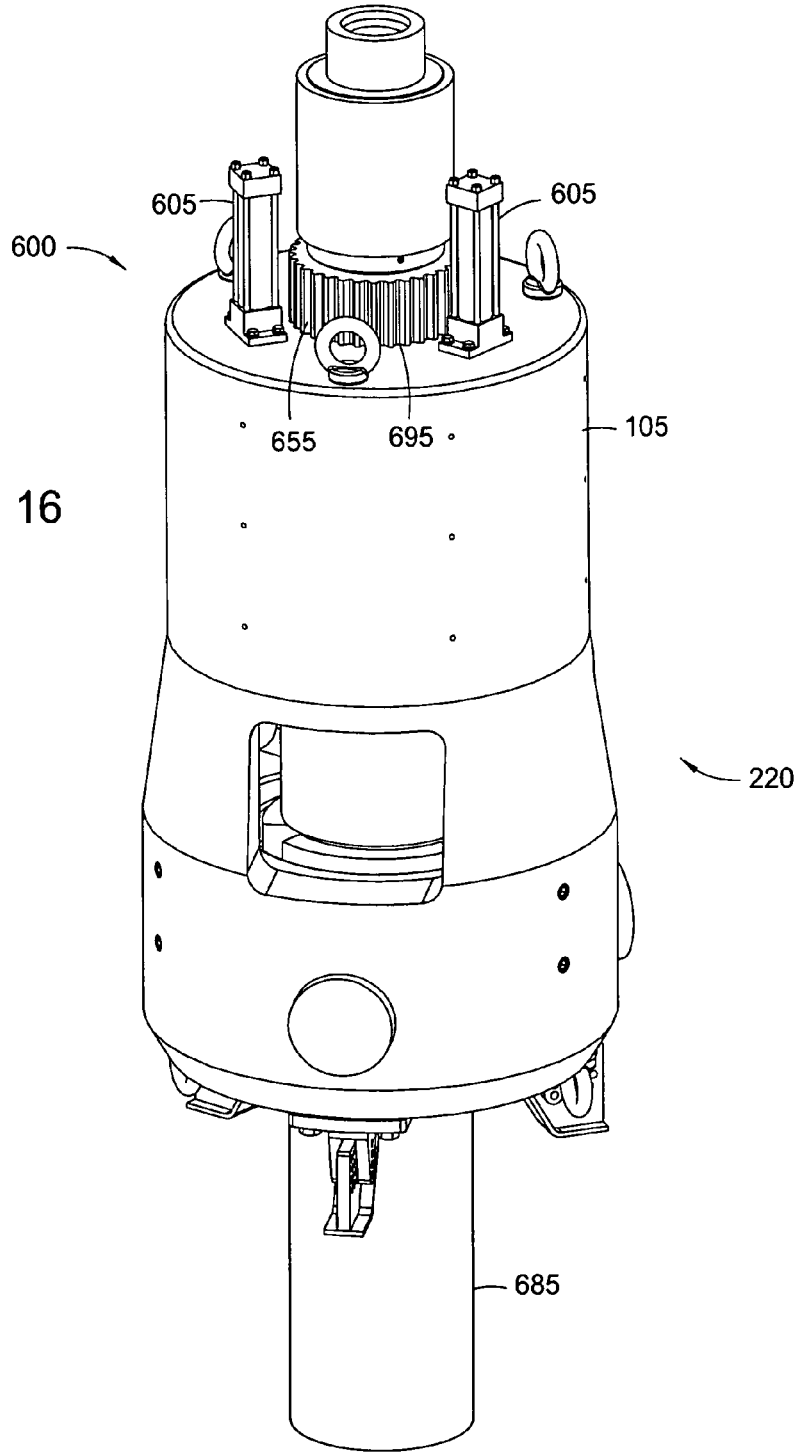
FIG. 16 is an isometric view illustrating the compensator apparatus.

FIG. 16 is an isometric view illustrating the preferred embodiment of the compensating apparatus 600. As clearly shown, a plurality of cylinders 605 are rigidly attached to the housing 105 of the torque head 220. As further shown, the spline mandrel 655 is engaged with the housing face 695.

In the embodiments shown in FIGS. 7-16, the compensator apparatus 500, 600 may be utilized to compensate when drilling with casing as well as while making up and/or breaking out threadable connections between casing sections and/or casing strings. The compensator apparatus 500, 600 shown and described in relation to FIGS. 7-16 may be used when using the cementing/circulating tool 2 shown and described in relation to FIGS. 1-6 to perform a drilling with casing operation.

Figure 17:
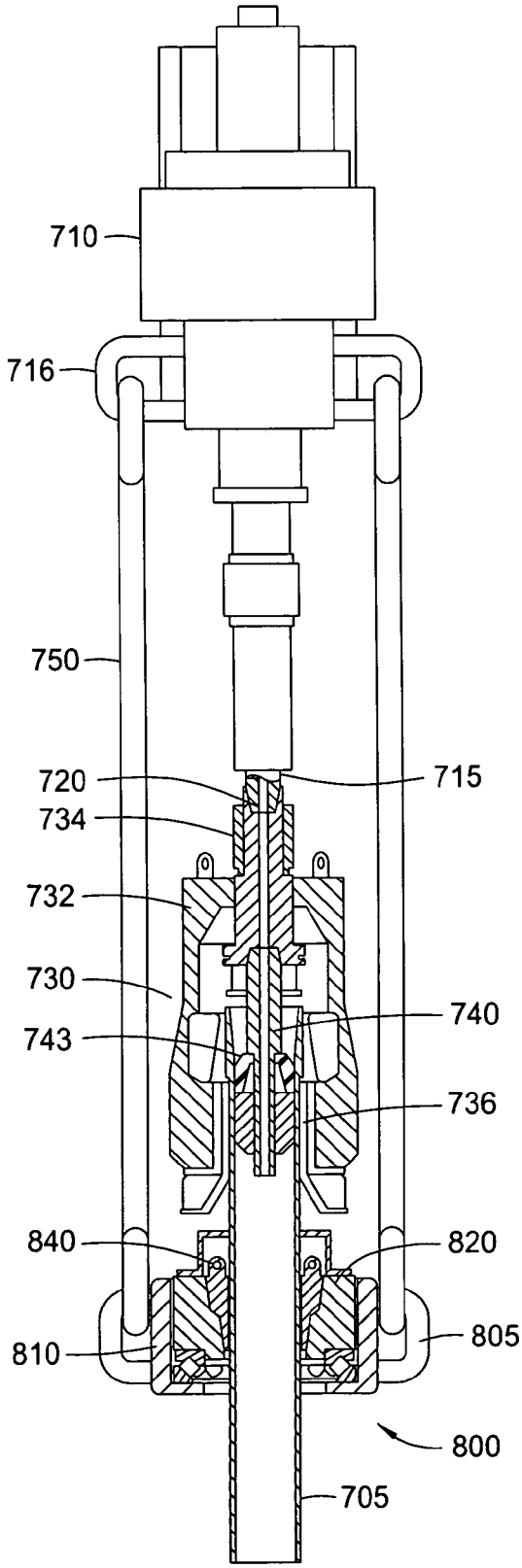
FIG. 17 is a cross-sectional view of a top drive system having an elevator according to aspects of the present invention.

FIG. 17 shows a tensile load isolating elevator 800 according to one aspect of the present invention. The load isolating elevator 800 may be used to isolate a tensile load from a top drive connection 720.

The load isolating elevator 800 may be utilized to isolate tensile load from the top drive connection when utilizing the gripping head 220 or 11 and associated circulating/cementing tool 2 shown and described in relation to FIGS. 1-6. Additionally, the load isolating elevator 800 may be utilized with the compensator apparatus 500 or 600 shown and described in relation to FIGS. 7-16.

The load isolating elevator 800 may be used with a top drive system as shown in FIG. 17. The system includes a top drive 710, a gripping head 730, and the load isolator elevator 800. The top drive 710 may be any suitable top drive known to a person of ordinary skill in the art. The quill 715, or spindle, interconnects the top drive 710 and the gripping head 730, thereby forming the top drive connection 720. In this respect, torque may be transmitted from the top drive 710 to the gripping head 730. The gripping head 730 is shown gripping a tubular 705, such as a casing.

The gripping head 730 may be an external gripping head such as a torque head, an internal gripping head such as a spear, or any suitable gripping head known to a person of ordinary skill in the art. An example of a suitable torque head is disclosed in U.S. patent application Ser. No. 09/550,721, filed on Apr. 17, 2000, entitled "Top Drive Casing System", which was above incorporated by reference. FIG. 17 illustrates another example of a suitable torque head 730. As shown, the torque head 730 includes a housing 732 and a connector sub 734 for connecting the torque head 730 to the quill 715 of the top drive 710. The torque head 730 may be equipped with one or more gripping members 736 for holding the casing 705.

The torque head 730 may also include a fill-up/circulating tool 740 for circulating drilling fluid. The circulating tool 740 is shown with an end attached to the torque head 730 and an end inserted into the casing 705. The circulating tool 740 may include one or more sealing elements 743 to seal an interior of the casing 705 in order to circulate fluid or mud. Aspects of the present invention are usable with any suitable fill-up/circulating tool known to a person of ordinary skill in the art. In one embodiment, the fill-up/circulating tool 740 may include the circulating/cementing tool 2 shown and describe in relation to FIGS. 1-16.

The load isolator elevator 800 may be suspended by bails 750 from eyes 716 of the top drive 710. In one embodiment, the elevator 800 is connected to the bails 750 through attachment members 805, such as hooks or eyes. The attachment members 805 are connected to the isolator body 810 of the elevator 800.

Figure 18:
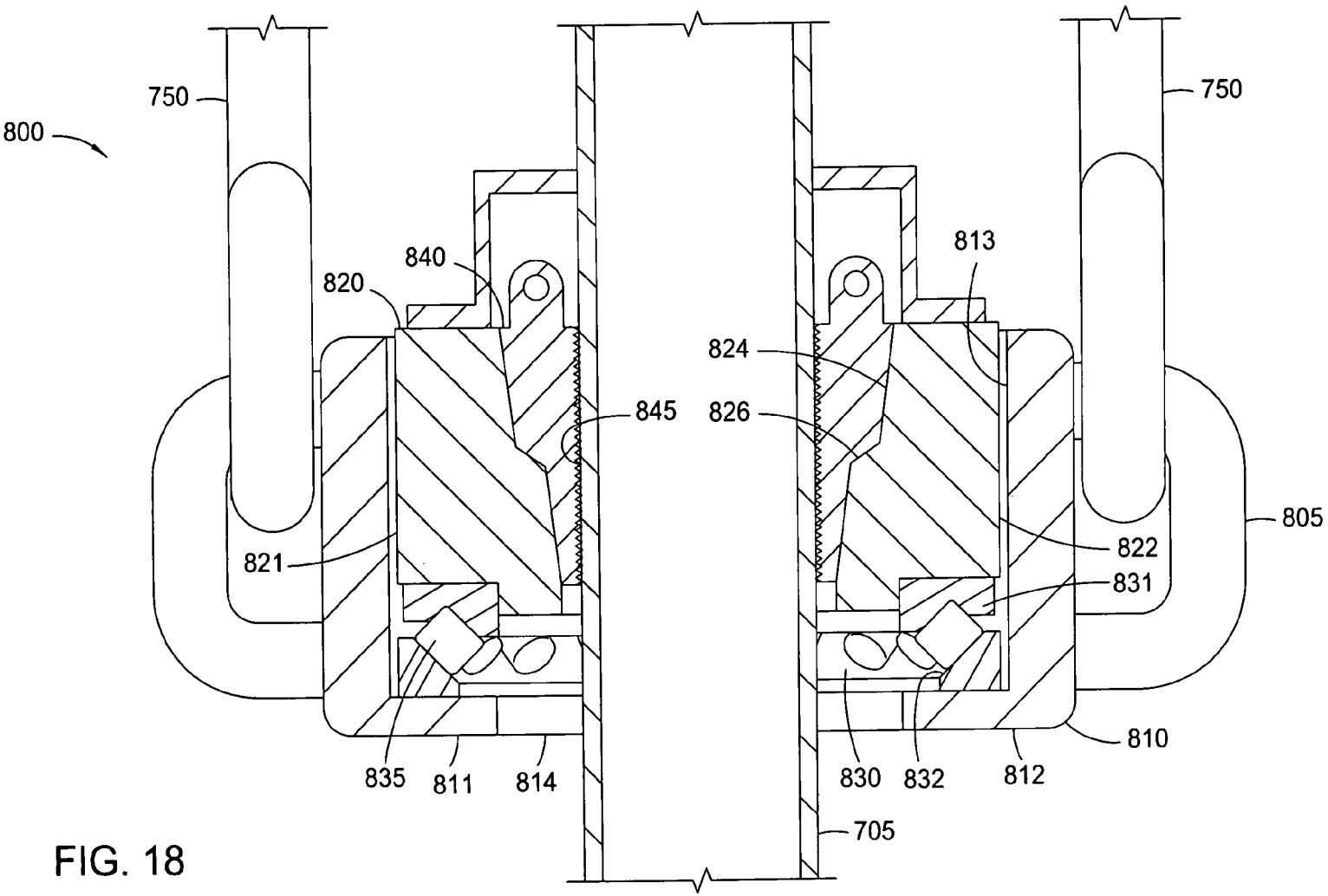
FIG. 18 is an exploded cross-sectional view of the elevator shown in FIG. 17.

FIG. 18 is a cross-sectional view of the elevator 800 according to aspects of the present invention. As illustrated in FIG. 18, the isolator body 810 defines a first opening 813 at one end for maintaining a torque body 820. The isolator body 810 also has a second opening 814 at another end to accommodate the casing 705. Preferably, a diameter of the first opening 813 is larger than a diameter of the second opening 814. In one embodiment, the isolator body 800 defines two arcuate portions 811, 812 hingedly connected and hingedly openable from at least one side of the elevator 800.

In one embodiment, the torque body 820 defines a slip bowl 820. The slip bowl 820 is concentrically disposed in the first opening 813 of the isolator body 810. Preferably, the slip bowl 820 defines two portions 821, 822 hingedly connected to form an annular member. The slip bowl 820 further defines a conical bore 824 that is concentric with the slip bowl 820. The conical bore 824 is tapered downwardly to support one or more slips. 840. Each slip 840 defines an arcuate, wedge-shaped portion having a straight front surface and a sloped back surface that matches the conical bore 824 of the slip bowl 820. The slips 840 may be mounted in spaced apart relation about the slip bowl 820 with the front surface closest to the central axis of the bore 824. The front surface of the slip 840 may include one or more inserts 845 for gripping the casing 705. In another embodiment, the tapered surface of the conical bore 824 may include a tapered shoulder 826, as shown in FIG. 18, to limit the downward movement of the slips 840 relative to the slip bowl 820.

The slips 840 are moveable axially within the slip bowl 820, preferably by one or more piston and cylinder assemblies (not shown) attached to the upper portion of the slips 840. Specifically, in one embodiment, the slips 820 are attached to a ring (not shown) having cylinders (not shown) which move the slips 820.

The slip bowl 820 is supported in the elevator 800 using a bearing assembly 830. The bearing assembly 830 may include one or more bearings 835 disposed between two races 831, 832. In one embodiment, the bearing assembly 830 is disposed between the slip bowl 820 and the isolator body 810. Preferably, a first race 831 is disposed on a lower portion of the slip bowl 820, and a second race 832 is disposed on an interior surface of the isolator body 810. The bearing assembly 830 is adapted and designed to allow the slip bowl 820 to rotate relative to the isolator body 810. Additionally, the bearing assembly 830 is adapted and designed to transmit axial load from the slip bowl 820 to the isolator body 810. In this respect, the bearing assembly 830 acts both as a thrust and a radial bearing. The isolator body 810, in turn, transmits the axial load to the bails 750. In this manner, tensile load may be isolated from the top drive connection 720 or the torque head 730 during operation. Aspects of the present invention encompass other suitable types of bearing assemblies or load transferring members known to a person of ordinary skill in the art, so long as the load transferring member is capable of transferring tensile load from the slip bowl 820 to the isolator body 810, while allowing rotation relative thereto.

The bails 750 of the top drive system may attempt to twist during rotation; therefore, the bails 750 may be rigidly attached to the top drive track or body (or any other non-rotating body). A holding system (not shown) may be attached to the isolator body 810 and ride on the same rails (or other non-rotating member) as the top drive 710 (or any other non-rotating body) to prevent the twisting of the bails 750 and take the reactionary torque when the casing 705 is rotated. The holding system is detachable in one embodiment.

In another embodiment, a plurality of bearing assemblies may be used to isolate tensile load from the top drive connection. One or more radial bearing assemblies may be disposed between the annular area between the isolator body 810 and the slip bowl 820. The radial bearing assemblies allow the slip bowl 820 to rotate relative to the isolator body 810. Additionally, one or more thrust bearing assemblies may be disposed at a lower portion of the slip bowl 820 between the slip bowl 820 and the isolator body 810. The thrust bearing assembly may transfer the load on the slip bowl 820 to the isolator body 810.

In operation, an elevator 800 according to aspects of the present invention may be used to isolate the tensile load from the torque head 730 and the top drive connection 720. Referring to FIG. 17, a top drive system is shown having a torque head 730 connected to the top drive 710. Also shown is an elevator 800 operatively connected to the top drive 710. The casing 705 is shown gripped by the gripping members 736 of the torque head 730 and the slips 840 of the elevator 800. Additionally, a fill-up/circulating tool 740 has been inserted into the casing 705.

In this position, the tensile load of the casing 705 is transferred to the slip bowl 820. In turn, the tensile load is transferred from the slip bowl 820 to the isolator body 810 through the bearing assembly 830, which is then transferred to the bails 750. In this respect, the tensile load is substantially transferred away from the torque head 730.

When the top drive 710 is actuated, torque from the top drive 710 is transferred to the torque head 730, thereby rotating the casing 705. The rotation of the casing 705 also causes the slips 840 and the slip bowl 820 to rotate. During operation, the bails 750 and the detachable holding system tied to the rails that the top drive 710 rides along maintain the elevator 800 in a substantially non-rotational manner relative to the slip bowl 820. The bearing assembly 830 allows the slips 840 and the slip bowl 820 to rotate relative to the isolator body 810. In this manner, tensile load may be isolated from the torque head 730, thereby allowing the torque head 730 to rotate a heavier string of casing 705.

The torque head 730 may include the compensator apparatus 500 shown and described in relation to FIGS. 7-12 above or the compensator apparatus 600 shown and described in relation to FIGS. 13-16 above. When the compensator apparatus 500 or 600 is utilized with the torque head 730, the compensator apparatus 500 or 600 allows release from the slips 840 when the casing 705 is supported at the rig floor by a spider/slip system.

Figure 19:
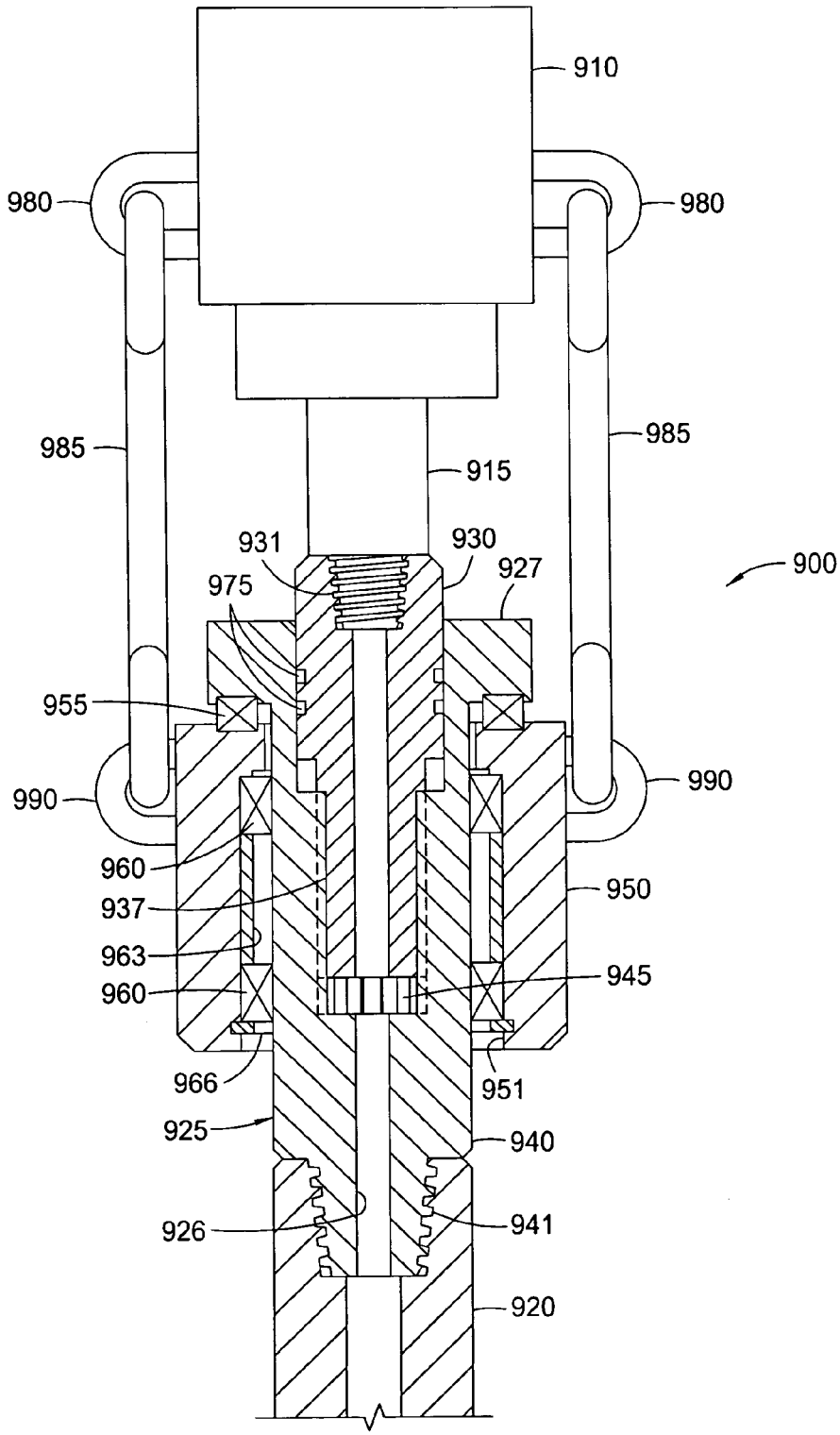
FIG. 19 is a cross-sectional view of a top drive isolator adapter according to aspects of the present invention.

In another aspect, an isolator adapter 900 may be coupled to the top drive 910 to isolate tensile load from the quill 915 of the top drive 910 as shown in FIG. 19. The isolator adapter 900 may also transfer torque to a drilling apparatus 920 attached therebelow. It is understood that the drilling apparatus 920 may include any suitable apparatus typically attached to a top drive, including, but not limited to, a torque head, a spear, and a joint compensator, as well as tubulars such as casing and drill pipe, as is known to a person of ordinary skill in the art. A track system (not shown) may be included with the system of FIG. 19 that rides on the rails (or any other non-rotating member) of the top drive 910 (or any other non-rotating body) connected to the isolator body 950 to oppose the reactionary torque transmitted through the bearings 955 and 960.

The isolator adapter 900 includes a torque body 925 concentrically disposed in the isolator body 950. The torque body 925 defines an upper body 930 at least partially disposed in a lower body 940. The upper body 930 is coupled to the lower body 940 using a spline and groove connection 937. Any suitable spline and groove assembly known to a person of ordinary skill in the art. A section of the spline and groove on the lower body is shown as 945.

An upper portion of the torque body 925 includes a first coupling 931 for connection to the quill 915 and a lower portion includes a second coupling 941 for connection to the drilling apparatus 920. In one embodiment, the first and second couplings 931, 941 are threaded connections. Preferably, the second coupling 941 has a larger threaded connection than the first coupling 931. The torque body 925 defines a bore 926 therethrough for fluid communication between the top drive 910 and the drilling apparatus 920. One or more seals 975 may be disposed between the upper body 930 and the torque body 925 to prevent leakage.

The isolator body 950 defines an annular member having a central opening 951 therethrough. The torque body 925 is co-axially disposed through the central opening 951 of the isolator body 950. The isolator body 950 is operatively coupled to the top drive 910 using at least two bails 985. One end of the bails 985 is connected to the hooks or eyes 980 of the top drive 910, while the other end is connected to the attachment members 990 of the isolator body 950.

The isolator adapter 900 may further include one or more bearing assemblies 955, 960 for coupling the torque body 925 to the isolator body 950. As shown in FIG. 19, a thrust bearing assembly 955 may be disposed between a flange 927 of the torque body 925 and the isolator body 950. The thrust bearing assembly 955 is adapted and designed to transfer tensile or thrust load from the torque body 925 to the isolator body 950. The thrust bearing assembly 955 may include any suitable bearing assembly, such as a roller bearing assembly, or load transferring apparatus known to a person of ordinary skill in the art.

One or more radial bearing assemblies 960 may be disposed in the annular area between the torque body 925 and the isolator body 950. The radial bearing assemblies 960 are adapted and designed to facilitate the rotation of the torque body 925 relative to the isolator body 950. As shown, the radial bearing assemblies 960 may be separated by a spacer 963. A snap ring 966 or any other suitable retaining means is used to retain the bearing assemblies 960 in the isolator body 950. It is understood that a bearing assembly acting as both a thrust and radial bearing, such as the bearing assembly described in the above elevator embodiment, may be used without deviating from the aspects of the present invention.

In operation, the isolator adapter 900 is disposed between the top drive 910 and the drilling apparatus 920. The upper body 930 is connected to the quill 915, while the lower body 940 is connected to the drilling apparatus 920. The isolator body 950 is operatively connected to the top drive 910 using the bails 985. Because the bails 985 are a predetermined length, the spline and groove connection 937 allows the upper body 930 to move axially relative to the lower body 940 in order to compensate for the axial distance required to threadedly connect the upper body 930 to the top drive 910. Once connected, the tensile load of the drilling apparatus 920 is transferred to the lower body 940, which, in turn, transfers the load to the isolator body 950 via the thrust bearing assembly 955. The tensile load is ultimately transferred to the bails 985. In this respect, the tensile load is isolated from the quill 915 of the top drive 910. Optionally, in another aspect, a universal joint (not shown) may be added between the quill thread 931 and the body 930 to allow connection of the pipe to the thread 941 and/or to allow the gripping device (not shown) to grip the casing or pipe when located off the well center.

The isolator adapter 900 may also transmit torque from the top drive 910 to the drilling apparatus 920. The torque is initially transferred from the quill 915 to the upper body 930 through the threaded connection 931. Thereafter, the torque is transferred to the lower body 940 via the spline and groove connection 937. The lower body 940 then transfers the torque to the drilling apparatus 920 by a threaded connection 941, thereby rotating the drilling apparatus 920.

One advantage of the present invention is that existing top drive systems may be retrofitted to handle a higher tensile load during operation. In one aspect, the first and second couplings 931, 941 may be designed and rated to carry different loads. As schematically shown in FIG. 19, the second coupling 941 is larger than the first coupling 931. The first coupling 931 is designed to be connected to many existing top drive quills 915. The second coupling 941 is designed to be connected to a drilling apparatus 920 redesigned with a larger threaded connection in order to increase its tensile load capacity. For example, the first coupling 931 may include a 6 ⅝ connection for connecting to a quill 915 of an existing top drive 910. On the other hand, the second coupling 941 may include an 8⅝ connection for connecting to a redesigned drilling apparatus 920. In this manner, many existing top drives may be retrofitted to handle a higher tensile load during drilling, thereby allowing the same top drive to drill deeper.

Figure 20:
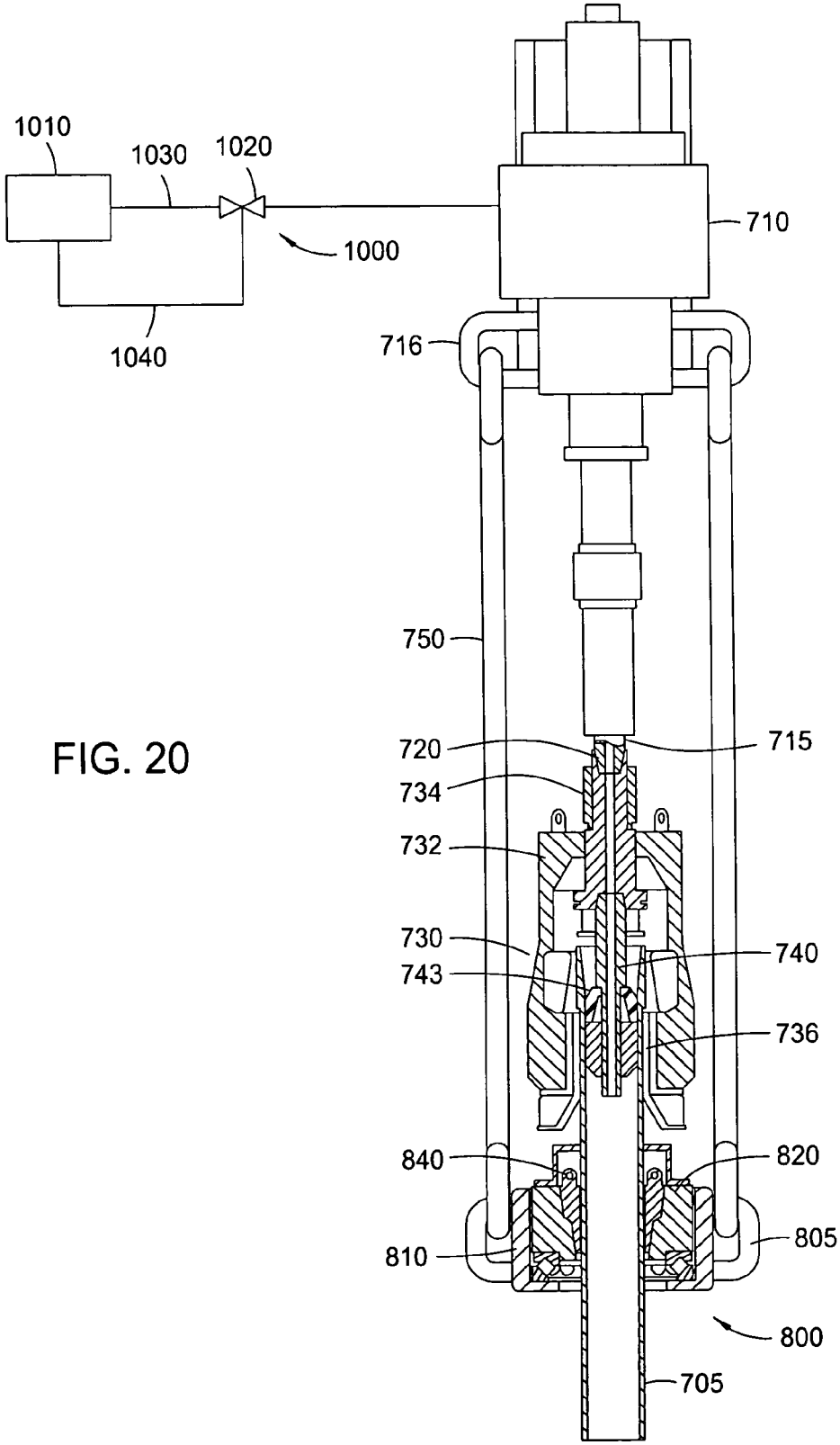
FIG. 20 is a view of a top drive system equipped with an apparatus for controlling the fluid pressure supplied to the top drive.

In another aspect, the present invention provides an apparatus 1000 for controlling the torque provided by the top drive 710 during tubular connection or disconnection. FIG. 20 is a schematic representation of the apparatus 1000 for controlling a top drive 710. As shown in FIG. 20, the top drive 710 is connected to a pump 1010 for supplying fluid pressure. A pressure relief valve 1020, or dump valve, may be disposed on the fluid supply line 1030 connecting the pump 1010 to the top drive 710. The pressure relief valve 1020 may be adapted and designed to redirect fluid in the supply line 1030 to a return line 1040 when the pressure in the supply line 1030 reaches a predetermined pressure. In this respect, the torque generated by the top drive 710 is limited by the pressure relief valve 1020. In this manner, the torque provided to connect or disconnect tubulars may be controlled to prevent damage to the connecting threads. It must be noted that aspects of the present invention may be used with any suitable pressure relief valve known to a person of ordinary skill in the art.

The embodiments shown and described in relation to FIGS. 1-20 may be utilized with casing and/or any other tubular body, including but not limited to drill pipe, tubing, and liner. Embodiments of FIGS. 1-20 are usable when running casing, drilling with casing, lowering or running one or more tubulars into a wellbore, retrieving/fishing one or more tubulars from the wellbore, and/or threading tubulars together or separating threaded connections between one or more tubulars. The systems of FIGS. 1-20 may be utilized to rotate the entire casing, a portion of the casing (such as a drill shoe or drill bit) may be rotated by a mud motor disposed on the casing, and/or the casing may be lowered into the earth while circulating drilling fluid without rotating any portion of the casing.

An embodiment of the present invention provides an apparatus for use while drilling with casing comprising a gripping member for grippingly engaging the casing; and a circulating seal member for circulating fluid through the casing while drilling with the casing, wherein the circulating seal member is interchangeable with a cementing plug holder having a fluid path therethrough for circulating a physically alterable bonding material through the casing. In one aspect, the physically alterable bonding material is introduced into the casing below a top drive connected above the gripping member.

Another embodiment of the present invention provides an apparatus for use while drilling with casing comprising a gripping member for grippingly engaging the casing; and a circulating seal member for circulating fluid through the casing while drilling with the casing, wherein the circulating seal member is interchangeable with a cementing plug holder having a fluid path therethrough for circulating a physically alterable bonding material through the casing and the cementing plug holder comprises at least one plug releasable into the casing by a slidable mandrel. In one aspect, the slidable mandrel translates longitudinally to release the at least one plug. In another aspect, fluid introduced behind the slidable mandrel translates the slidable mandrel.

Another embodiment of the present invention provides an apparatus for use while drilling with casing comprising a gripping member for grippingly engaging the casing; and a circulating seal member for circulating fluid through the casing while drilling with the casing, wherein the circulating seal member is interchangeable with a cementing plug holder having a fluid path therethrough for circulating a physically alterable bonding material through the casing, and further including a compensator apparatus disposed adjacent the gripping member. In one aspect, the compensator apparatus allows substantially co-axial movement of the casing relative to a top drive. In an aspect, the top drive is operatively connected to the compensator apparatus.

Another embodiment of the present invention provides an apparatus for use while drilling with casing comprising a gripping member for grippingly engaging the casing; and a circulating seal member for circulating fluid through the casing while drilling with the casing, wherein the circulating seal member is interchangeable with a cementing plug holder having a fluid path therethrough for circulating a physically alterable bonding material through the casing, and further including a compensator apparatus disposed adjacent the gripping member, wherein the compensator apparatus includes a cylinder mechanically attached at one end to the gripping member and an opposite end of the cylinder operatively attached to a mandrel to form a torque connection. In one aspect, the torque connection is constructed and arranged from a spline arrangement. In another aspect, the cylinder is moveable axially relative to the mandrel, thereby allowing the gripping member to move axially relative to a top drive while maintaining the torque connection.

Another embodiment of the present invention provides an apparatus for use while drilling with casing comprising a gripping member for grippingly engaging the casing; a circulating seal member for circulating fluid through the casing while drilling with the casing, wherein the circulating seal member is interchangeable with a cementing plug holder having a fluid path therethrough for circulating a physically alterable bonding material through the casing; a top drive having an isolator body operatively connected thereto, the gripping member at least partially disposed in the isolator body and rotatable relative to the isolator body; and a bearing assembly located between the isolator body and the gripping member to transfer a tensile load from the gripping member to the isolator body. In one aspect, the bearing assembly permits relative rotation between the isolator body and the gripping member.

In another embodiment, the present invention includes an apparatus for drilling with casing comprising a head having at least one dart disposed therein; a torque head for gripping a casing; and a cementing head including at least one plug. In one aspect, the apparatus further comprises a top drive operatively attached to the head, wherein the top drive provides rotational torque to the torque head. In an embodiment, the apparatus further comprises a compensating apparatus disposed at least partially within the torque head. In a yet further embodiment, the compensating apparatus further comprises a cylinder mechanically attached at one end to the torque head and an opposite end of the cylinder operatively attached to a mandrel to form a torque connection. In one aspect, the torque connection is a spline arrangement. In a yet further embodiment, the cylinder moves axially relative to the mandrel, thereby allowing the torque head to move axially relative to the top drive while maintaining the torque connection.

In another embodiment, the present invention includes a load isolator apparatus for use with a top drive, the top drive adapted to rotate a tubular, comprising an isolator body operatively connected to the top drive; a torque body at least partially disposed in the isolator body, wherein the torque body is rotatable relative to the isolator body; and a bearing assembly disposed between the isolator body and the torque body, wherein the bearing assembly transfers a tensile load from the torque body to the isolator body. In one aspect, the bearing assembly allows relative rotation between the isolator body and the torque body. In another embodiment, the present invention includes a load isolator apparatus for use with a top drive, the top drive adapted to rotate a tubular, comprising an isolator body operatively connected to the top drive; a torque body at least partially disposed in the isolator body, wherein the torque body is rotatable relative to the isolator body; a bearing assembly disposed between the isolator body and the torque body, wherein the bearing assembly transfers a tensile load from the torque body to the isolator body; and a radial bearing assembly for allowing relative rotation between the isolator body and the torque body.

In another embodiment, the present invention includes a load isolator apparatus for use with a top drive, the top drive adapted to rotate a tubular, comprising an isolator body operatively connected to the top drive; a torque body at least partially disposed in the isolator body, wherein the torque body is rotatable relative to the isolator body; a bearing assembly disposed between the isolator body and the torque body, wherein the bearing assembly transfers a tensile load from the torque body to the isolator body; and one or more gripping members for gripping the tubular. In one aspect, the one or more gripping members are disposed in a bore of the torque body. In one embodiment, the load isolator apparatus further comprises one or more inserts disposed on a surface of the one or more gripping members.

In another embodiment, the present invention includes a load isolator apparatus for use with a top drive, the top drive adapted to rotate a tubular, comprising an isolator body operatively connected to the top drive; a torque body at least partially disposed in the isolator body, wherein the torque body is rotatable relative to the isolator body; and a bearing assembly disposed between the isolator body and the torque body, wherein the bearing assembly transfers a tensile load from the torque body to the isolator body, wherein the torque body comprises an upper body coupled to a lower body such that the upper body is movable axially relative to the lower body and capable of transmitting torque thereto. In one aspect, the upper body is coupled to the lower body using a spline and groove connection.

In another embodiment, the present invention includes a load isolator apparatus for use with a top drive, the top drive adapted to rotate a tubular, comprising an isolator body operatively connected to the top drive; a torque body at least partially disposed in the isolator body, wherein the torque body is rotatable relative to the isolator body; and a bearing assembly disposed between the isolator body and the torque body, wherein the bearing assembly transfers a tensile load from the torque body to the isolator body, wherein the torque body comprises an upper body coupled to a lower body such that the upper body is movable axially relative to the lower body and capable of transmitting torque thereto, wherein a first threaded connection of the torque body is rated for higher loads than a second threaded connection of the torque body. In another embodiment, the present invention includes a load isolator apparatus for use with a top drive, the top drive adapted to rotate a tubular, comprising an isolator body operatively connected to the top drive; a torque body at least partially disposed in the isolator body, wherein the torque body is rotatable relative to the isolator body; and a bearing assembly disposed between the isolator body and the torque body, wherein the bearing assembly transfers a tensile load from the torque body to the isolator body, wherein a first threaded connection of the torque body is rated for higher loads than a second threaded connection of the torque body. In one aspect, the second threaded connection is threadedly connected to the top drive. In one embodiment, the first threaded connection is threadedly connected to the tubular.

In another embodiment, the present invention includes a method of rotating a drilling apparatus having a tensile load using a top drive, comprising operatively connecting a load isolator apparatus to the top drive, the load isolator apparatus comprising a torque body disposed in an isolator body; transferring the tensile load to the torque body; transferring the tensile load from the torque body to the isolator body; and rotating the torque body relative to the isolator body, thereby rotating the drilling apparatus. In one embodiment, the method further comprises providing the load isolator apparatus with one or more bearing assemblies. In one aspect, the one or more bearing assemblies comprise a thrust bearing assembly. In another aspect, the one or more bearing assemblies further comprise a radial bearing assembly.

In another embodiment, the present invention includes a method of rotating a drilling apparatus having a tensile load using a top drive, comprising operatively connecting a load isolator apparatus to the top drive, the load isolator apparatus comprising a torque body disposed in an isolator body; transferring the tensile load to the torque body; transferring the tensile load from the torque body to the isolator body; rotating the torque body relative to the isolator body, thereby rotating the drilling apparatus; providing the load isolator apparatus with one or more bearing assemblies, wherein the one or more bearing assemblies comprise a thrust bearing assembly, wherein the thrust bearing assembly facilitates the rotation of the torque body relative to the isolator body.

In another embodiment, the present invention includes a method of rotating a drilling apparatus having a tensile load using a top drive, comprising operatively connecting a load isolator apparatus to the top drive, the load isolator apparatus comprising a torque body disposed in an isolator body; transferring the tensile load to the torque body; transferring the tensile load from the torque body to the isolator body; and rotating the torque body relative to the isolator body, thereby rotating the drilling apparatus, wherein operatively connecting a load isolator apparatus to the top drive comprises threadedly connecting the torque body to a quill of the top drive; and connecting the isolator body to the top drive. In one aspect, the method further comprises compensating for an axial distance of the threaded connection between torque body and the top drive. In another embodiment, the present invention includes a method of rotating a drilling apparatus having a tensile load using a top drive, comprising operatively connecting a load isolator apparatus to the top drive, the load isolator apparatus comprising a torque body disposed in an isolator body; transferring the tensile load to the torque body; transferring the tensile load from the torque body to the isolator body; rotating the torque body relative to the isolator body, thereby rotating the drilling apparatus; and sealing off an area between the torque body and the isolator body to prevent leakage.

Another embodiment of the present invention includes an elevator for use with a top drive, comprising an isolator body; a torque body at least partially disposed in the isolator body, the torque body defining a conical bore; one or more slip members disposed in the conical bore; one or more bearing members disposed between the torque body and the isolator body, wherein the torque body is rotatable relative to the isolator body, and wherein a tensile load acting on the torque body is transferred to the isolator body. In one embodiment, the elevator further comprises one or more attachment members for attaching to a bail operatively connected to the top drive.

Another embodiment of the present invention includes an elevator for use with a top drive, comprising an isolator body; a torque body at least partially disposed in the isolator body, the torque body defining a conical bore; one or more slip members disposed in the conical bore; one or more bearing members disposed between the torque body and the isolator body, wherein the torque body is rotatable relative to the isolator body, and wherein a tensile load acting on the torque body is transferred to the isolator body, wherein the one or more bearing members comprise a radial bearing assembly and a thrust bearing assembly. Another embodiment of the present invention includes an elevator for use with a top drive, comprising an isolator body; a torque body at least partially disposed in the isolator body, the torque body defining a conical bore; one or more slip members disposed in the conical bore; one or more bearing members disposed between the torque body and the isolator body, wherein the torque body is rotatable relative to the isolator body, and wherein a tensile load acting on the torque body is transferred to the isolator body, wherein the one or more bearing members comprise a bearing assembly acting as both a thrust bearing and a radial bearing.

Another embodiment of the present invention includes a top drive adapter for use with a top drive to rotate a drilling apparatus, comprising an isolator body; a torque body at least partially disposed in the isolator body, the torque body having a first coupling and a second coupling; and one or more bearing members disposed between the torque body and the isolator body, wherein the torque body is rotatable relative to the isolator body, and wherein a tensile load acting on the torque body is transferred to the isolator body. In one embodiment, the adapter further comprises one or more attachment members for attaching to a bail operatively connected to the top drive.

Another embodiment of the present invention includes a top drive adapter for use with a top drive to rotate a drilling apparatus, comprising an isolator body; a torque body at least partially disposed in the isolator body, the torque body having a first coupling and a second coupling; and one or more bearing members disposed between the torque body and the isolator body, wherein the torque body is rotatable relative to the isolator body, and wherein a tensile load acting on the torque body is transferred to the isolator body, wherein the one or more bearing members comprise a radial bearing assembly and a thrust bearing assembly. Another embodiment of the present invention includes a top drive adapter for use with a top drive to rotate a drilling apparatus, comprising an isolator body; a torque body at least partially disposed in the isolator body, the torque body having a first coupling and a second coupling; and one or more bearing members disposed between the torque body and the isolator body, wherein the torque body is rotatable relative to the isolator body, and wherein a tensile load acting on the torque body is transferred to the isolator body, wherein the one or more bearing members comprise a bearing assembly acting as both a thrust bearing and a radial bearing. Another embodiment of the present invention includes a top drive adapter for use with a top drive to rotate a drilling apparatus, comprising an isolator body; a torque body at least partially disposed in the isolator body, the torque body having a first coupling and a second coupling; and one or more bearing members disposed between the torque body and the isolator body, wherein the torque body is rotatable relative to the isolator body, and wherein a tensile load acting on the torque body is transferred to the isolator body, wherein the torque body comprises an upper body at least partially disposed in a lower body, wherein the upper body is movable axially relative to the lower body and capable of transmitting torque to the lower body.

Another embodiment of the present invention includes an apparatus for controlling the fluid pressure of a top drive supplied by a pump, comprising a fluid supply line disposed between the pump and the top drive for supplying fluid to the top drive; a pressure relief valve disposed on the fluid supply line between the top drive and the pump; and a fluid return line connecting the pressure relief valve and the pump, wherein the pressure relief valve redirects the fluid back to the pump via the fluid return line when a fluid pressure reaches a predetermined level. Another embodiment of the present invention includes an apparatus for regulating an operating fluid from a fluid source to a top drive, comprising a valve disposed between the fluid source and the top drive, wherein the valve directs the operating fluid away from the top drive when a fluid pressure in the top drive reaches a predetermined level.

Another embodiment of the present invention includes an apparatus for cementing a casing within a formation comprising a gripping mechanism for grippingly and sealingly engaging the casing; and a cementing device connected to the gripping mechanism capable of launching at least one plug within the casing without releasing the gripping and sealing engagement with the casing. In one aspect, the gripping mechanism is a torque head. In another aspect, the gripping mechanism is a spear.

Another embodiment of the present invention includes an apparatus for cementing a casing within a formation comprising a gripping mechanism for grippingly and sealingly engaging the casing; and a cementing device connected to the gripping mechanism capable of launching at least one plug within the casing without releasing the gripping and sealing engagement with the casing, wherein an earth removal member is operatively connected to a lower end of the casing. Another embodiment of the present invention includes an apparatus for cementing a casing within a formation comprising a gripping mechanism for grippingly and sealingly engaging the casing; and a cementing device connected to the gripping mechanism capable of launching at least one plug within the casing without releasing the gripping and sealing engagement with the casing, wherein the cementing device launches the at least one plug by sliding a mandrel disposed within the cementing device axially.

Another embodiment of the present invention includes an apparatus for cementing a casing within a formation comprising a gripping mechanism for grippingly and sealingly engaging the casing; and a cementing device connected to the gripping mechanism capable of launching at least one plug within the casing without releasing the gripping and sealing engagement with the casing, wherein the cementing device launches at least one ball into a flow stream.

While the foregoing is directed to embodiments of the present invention, other and further embodiments of the invention may be devised without departing from the basic scope thereof, and the scope thereof is determined by the claims that follow.

The invention claimed is:

1. A method of forming a wellbore comprising:

operatively connecting a circulating head cementing tool to a gripping mechanism member and a top drive, the gripping mechanism member having a radially movable gripping element;

gripping a first casing with the gripping mechanism member;

sealingly engaging the first casing with a circulating seal member;

rotating the circulating head cementing tool, the gripping mechanism member, and the first casing; and lowering the first casing into the wellbore, wherein lowering the first casing into the formation comprises rotating an earth removal member operatively connected to a lower end of the first casing while introducing fluid through the first casing;

operatively connecting a cementing plug to the circulating head cementing tool;

gripping a second casing with the gripping mechanism member; and lowering the second casing into the wellbore.

2. The method of claim 1, further comprising:

releasing a portion of the cementing plug to plug fluid flow through the second casing; and introducing a physically alterable bonding material into the second casing.

3. The method of claim 2, wherein the portion of the cementing plug comprises at least one plug, and wherein releasing the portion of the cementing plug comprises releasing the at least one plug from the remainder of the cementing plug.

4. The method of claim 1, wherein the cementing plug comprises at least one plug having a bore therethrough.

5. The method of claim 4, wherein the cementing plug comprises a mandrel slidable upon introduction of fluid behind the mandrel.

6. The method of claim 5, wherein the mandrel biases at least one valve in the bore of the at least one plug in an open position.

7. The method of claim 6, wherein sliding the mandrel a first length closes the at least one valve on the at least one plug.

8. The method of claim 5, wherein releasing the portion of the cementing plug comprises sliding the mandrel a first length to release the at least one plug from a remainder of the cementing plug.

9. The method of claim 1, further comprising:

providing a compensator apparatus within the gripping mechanism member, the compensator apparatus operatively connected to the top drive; and allowing the gripping mechanism to translate coaxially with the compensator apparatus relative to the top drive.

10. The method of claim 1, further comprising:

providing an isolator body operatively connected to a top drive, the gripping mechanism member at least partially disposed within the isolator body; and allowing relative rotation between the isolator body and the gripping mechanism member.

11. The method of claim 10, wherein the isolator body transfers a tensile load from the gripping mechanism member to the isolator body.

12. The method of claim 1, further comprising flowing a fluid through a valve while lowering the first tubular into the formation.

13. The method of claim 12, further comprising introducing a physically alterable bonding material through the second tubular.

14. The method of claim 13, further comprising disposing the cementing plug between the fluid and the bonding material.

15. The method of claim 14, further comprising releasing a second cementing plug, whereby one of the cementing plugs is ahead of the bonding material and the other cementing plug is behind the bonding material.

16. The method of claim 12, further comprising removing the valve before connecting the cementing plug.

17. The method of claim 12, wherein the valve is a check valve.

18. The method of claim 1, further comprising urging an actuator member into engagement with the cementing plug, thereby releasing the cementing plug from the gripping mechanism.

19. The method of claim 18, wherein the actuator member comprises a dart or ball.

20. The method of claim 1, further comprising rotating at least a portion of the second casing while introducing fluid through the first casing.

21. The method of claim 1, further comprising axially moving a least a portion of the second casing while introducing fluid through the first casing.

22. The method of claim 1, wherein the cementing tool is adapted to convey a drilling fluid or cement.

23. The method of claim 1, further comprising pumping a fluid through the top drive, gripping mechanism, and the circulating head cementing tool.

24. The method of claim 1, wherein the gripping elements comprise slips.

25. A method of cementing a casing Within a formation, comprising:

providing the casing with an earth removal member located at a lower end;

providing a gripping mechanism connected to a cementing assembly and a top drive;

gripping the casing with the gripping mechanism;

sealingly engaging the casing with a circulating seal member;

rotating and lowering the earth removal member to a depth within the formation; and cementing the casing within the formation using the cementing assembly.

26. The method of claim 25, wherein the gripping mechanism is a torque head.

27. The method of claim 25, wherein the gripping mechanism is a spear.

28. The method of claim 25, wherein cementing the casing comprises selectively releasing at least one plug into the casing at least one plug located within the cementing assembly.

29. The method of claim 28, wherein the at least one plug is released by axial movement of a slidable mandrel disposed within the cementing assembly.

30. The method of claim 28, wherein the at least one plug is released by at least one ball selectively launched into a flow stream using a plug injector disposed above the cementing assembly.

31. The method of claim 25, wherein sealingly engaging the casing comprises urging a first circulating seal member against the casing.

32. The method of claim 31, wherein urging the first circulating seal member against the casing activates a second circulating seal member.

33. The method of claim 25, further comprising rotating the gripping mechanism while cementing.

34. The method of claim 25, wherein cementing is performed without releasing the gripping and sealing engagement of the casing.

35. The method of claim 31, further comprising rotating the gripping mechanism while cementing.

36. The method of claim 35, wherein the gripping mechanism is a spear.

37. The method of claim 35, wherein the gripping mechanism is a torque head.

38. The method of claim 35, wherein cementing the casing comprises selectively releasing at least one plug into the casing at least one plug located within the cementing assembly.

39. The method of claim 31, wherein cementing the casing comprises selectively releasing at least one plug into the casing at least one plug located within the cementing assembly.

40. An apparatus for use in drilling with casing, comprising:

a top drive having a fluid path;

a gripping member having radially movable gripping elements; and a cementing head and the gripping member fluidly connected to the fluid path and rotatable by an output shaft of the top drive, wherein the casing includes a drill bit.

41. The apparatus of claim 40, wherein the cementing head is rotationally fixed relative to the gripping member.

42. The apparatus of claim 40, further comprising a cup seal adapted to engage an interior surface of the casing.

43. The apparatus of claim 42, wherein the cup seal is connected to the gripping member.

44. The apparatus of claim 40, further comprising a cement plug.

45. The apparatus of claim 40, wherein the gripping member is adapted to grip an exterior surface of the casing.

46. The apparatus of claim 40, wherein the gripping member is adapted to grip an interior surface of the casing.

47. The apparatus of claim 40, wherein the cementing head comprises a launching member.

48. A method of forming a wellbore comprising:

operatively connecting a circulating head cementing tool to a gripping mechanism member and a top drive, the gripping mechanism member having a radially movable gripping element;

gripping a first tubular with the gripping mechanism member;

sealingly engaging the first tubular with a circulating seal member;

rotating the circulating head cementing tool, the gripping mechanism member, and the first tubular; and lowering the first tubular into the wellbore;

operatively connecting a cementing plug to the circulating head cementing tool, wherein the cementing plug comprises at least one plug having a bore therethrough and a mandrel slidable upon introduction of fluid behind the mandrel;

gripping a second tubular with the gripping mechanism member; and lowering the second tubular into the wellbore.

49. The method of claim 48, wherein the mandrel biases at least one valve in the bore of the at least one plug in an open position.

50. The method of claim 49, wherein sliding the mandrel a first length closes the at least one valve on the at least one plug.

51. The method of claim 48, wherein releasing the portion of the cementing plug comprises sliding the mandrel a first length to release the at least one plug from a remainder of the cementing plug.

52. A method of forming a wellbore comprising:

operatively connecting a circulating head cementing tool to a gripping mechanism member and a top drive, the gripping mechanism member having a radially movable gripping element;

providing an isolator body operatively connected to the top drive, the gripping mechanism member at least partially disposed within the isolator body;

allowing relative rotation between the isolator body and the gripping mechanism member;

gripping a first tubular with the gripping mechanism member;

sealingly engaging the first tubular with a circulating seal member;

rotating the circulating head cementing tool, the gripping mechanism member, and the first tubular; and lowering the first tubular into the wellbore;

operatively connecting a cementing plug to the circulating head cementing tool;

gripping a second tubular with the gripping mechanism member; and lowering the second tubular into the wellbore.

53. The method of claim 52, wherein the isolator body transfers a tensile load from the gripping mechanism member to the isolator body.

* * * * *